US008953956B2

(12) United States Patent
Kubo

(10) Patent No.: US 8,953,956 B2
(45) Date of Patent: Feb. 10, 2015

(54) IMAGE FORMING APPARATUS

(71) Applicant: Canon Kabushiki Kaisha, Tokyo (JP)

(72) Inventor: Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/753,718

(22) Filed: Jan. 30, 2013

(65) Prior Publication Data

US 2013/0195475 A1 Aug. 1, 2013

(30) Foreign Application Priority Data

Jan. 31, 2012 (JP) ..... 2012-018450

(51) Int. Cl.
*G03G 15/00* (2006.01)
*G03G 15/02* (2006.01)

(52) U.S. Cl.
CPC ..... *G03G 15/553* (2013.01); *G03G 15/0283* (2013.01)
USPC ..... 399/26; 399/11; 399/29; 399/50

(58) Field of Classification Search
USPC ..... 399/26, 50, 115, 168, 174, 176, 11, 29, 399/150
See application file for complete search history.

(56) References Cited

U.S. PATENT DOCUMENTS

| | | | | |
|---|---|---|---|---|
| 5,950,047 | A * | 9/1999 | Miyabe et al. | 399/111 |
| 7,783,212 | B2 * | 8/2010 | Ichikawa et al. | 399/48 |
| 7,899,352 | B2 * | 3/2011 | Tomiie et al. | 399/89 |
| 2006/0034627 | A1 * | 2/2006 | Kikuchi et al. | 399/24 |
| 2007/0140713 | A1 * | 6/2007 | Shima | 399/26 |
| 2008/0019711 | A1 * | 1/2008 | Nagamochi et al. | 399/26 |
| 2010/0008685 | A1 * | 1/2010 | Shibuya | 399/50 |
| 2012/0195604 | A1 * | 8/2012 | Kakigi | 399/26 |
| 2013/0177328 | A1 * | 7/2013 | Fukuda et al. | 399/43 |

FOREIGN PATENT DOCUMENTS

| | | | |
|---|---|---|---|
| JP | 54-143645 | A | 11/1979 |
| JP | 2004-45568 | A | 2/2004 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes a photosensitive drum; a charging rotatable member for charging the drum by applying a voltage comprising a DC voltage component and an AC voltage component; a current detector for detecting a current flowing when a predetermined inspecting voltage is applied to the charging rotatable member; a storing portion for storing information corresponding to a reference current; a supplying portion for supplying a signal for notifying information corresponding to a lifetime of the drum on the basis of information stored in the storing portion and an output of the current detector; and a renewing portion for renewing information stored in the storing portion in accordance with the output of the current detector.

8 Claims, 18 Drawing Sheets

IMAGE FORMING APPARATUS

FIELD OF THE INVENTION AND RELATED ART

The present invention relates to an image forming apparatus such as a copying machine, a printer, a facsimile machine, and multifunction machine having two or more functions of the preceding machines, and the like.

An image forming apparatus which forms an electrostatic image on the surface of the photosensitive layer of its photosensitive member, forms a toner image by developing the electrostatic image with the use of toner, transfer the toner image onto recording medium, directly or indirectly with the use of its intermediary transferring member, and apples heat and pressure to the recording medium and the toner image thereon in order to fix the toner image to the recording medium, is widely used.

An electrophotographic image forming apparatus charges its electrophotographic photosensitive member to charge the peripheral surface of the photosensitive member by placing its charging member in contact with the peripheral surface of the photosensitive drum, before it forms an electrostatic image on the surface of the photosensitive layer of its photosensitive member. As the photosensitive member is charged by the charging member, the photosensitive layer of the photosensitive member is gradually abraded by the friction between itself and the charging member, whereby it is made microscopically uneven. The photosensitive layer functions as a type of capacitor which holds electrical charge. Thus, as it is made thinner by the continual friction between itself and the charging member, it becomes nonuniform in thickness. As it becomes nonuniform in thickness, it fails to be uniformly charged by the charging member, resulting in the formation of an electrostatic image which is not uniform in the amount of electrical charge. With the electrostatic latent image being nonuniform in the amount of electric charge, the toner image which will result from the adhesion of toner to the electrostatic image will be nonuniform in the amount of toner adhesion per picture element. In other words, as an electrostatic image forming apparatus is reduced in the thickness of the photosensitive layer of its photosensitive member, it outputs images which are low in image quality. Therefore, the photosensitive member(s) of an electrophotographic image forming apparatus has to be replaced before its photosensitive layer becomes too thin to enable the image forming apparatus to remain no lower in image quality than a preset level.

There are various methods for estimating the thickness of the photosensitive layer of a photosensitive member. One of them is disclosed in Japanese Laid-open Patent Application 2004-45568. According to this application, the amount of electrical current which flows between the charging means and photosensitive member of an electrostatic image forming apparatus while oscillatory voltage, that is, a combination of DC voltage and AC voltage, is applied as charge bias to the charging means is measured. Then, the thickness of the photosensitive layer is obtained (estimated) from the amount of the change which occurred to the amount of the current which flows between the charging means and photosensitive member, relative to the amount of the electric current which flowed between the charging means and photosensitive member when the photosensitive member began to be used.

This method, however, suffers from the following problem. That is, some charging members are not stable in the amount of electrical resistance right after they are put to use, because of the material of which their electrically conductive layer is made. More specifically, after they begin to be used, they continue to reduce in the detected amount of the direct current which flows between the charging means and photosensitive member, for several hours to several days, even if the photosensitive member shows virtually no change in thickness in reality. They are different in the length of the period in which they reduce in the amount of this electric current. Therefore, if the amount of electrical current detected immediately after they began to be used is simply used as the referential amount, the detected amount of current between the charging means and photosensitive member reflects the change in the amount of electrical resistance of the charging means. Thus, the thickness of the photosensitive layer of the photosensitive member is erroneously detected, making it impossible to precisely detect the length of the residual life of the photosensitive member.

SUMMARY OF THE INVENTION

Thus, the primary object of the present invention is to provide an electrophotographic image forming apparatus which can more accurately informs a user of the length of the residual life of its photosensitive member(s) with the use of its rotational charging member(s) than any electrophotographic image forming apparatus in accordance with the prior art.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, embodiments of the present invention are described with reference to the appended drawings.

The present invention is applicable to any electrophotographic image forming apparatus as long as it renews in value the referential electric current amount which is to be used for estimating the thickness of the photosensitive layer of the photosensitive member, even if it is partially, or entirely different in structure from those in the following embodiments of the present invention.

That is, electrophotographic image forming apparatuses to which the present invention is applicable include those of which rotational charging member is positioned in the adjacencies of their photosensitive drum, and which charges the photosensitive drum with the use of AC voltage. That is, the present invention is applicable to any electrophotographic image forming apparatus regardless of the exposing method, development method, fixing method, and transferring method which the apparatuses employ. It is also applicable to an electrophotographic image forming apparatus, such as a monochromatic image forming apparatus having only one image formation station. The following embodiments of the present invention will be described with reference to only the primary sections of the apparatus, which are related to the process for forming an image with the use of toner. Further, the present invention is applicable to various image forming apparatuses, such as various printers, copying machines, facsimile machine, and multifunction machines, which are combinations of any of the image forming apparatuses in the following embodiments of the present invention, additional devices, and external shell (casing).

<Image Forming Apparatus>

Figure 1:
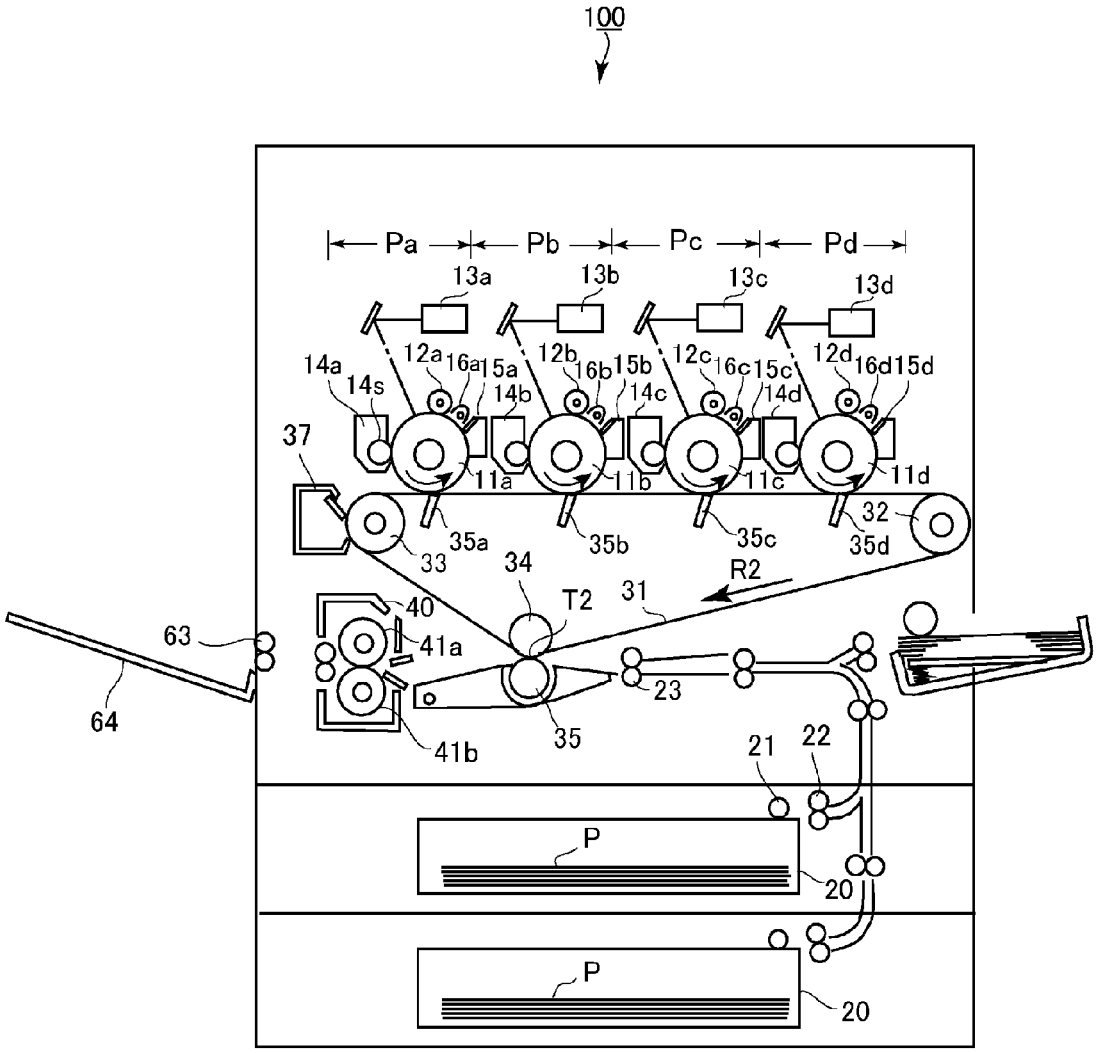
FIG. 1 is a schematic sectional view of a typical image forming apparatus to which the present invention is applicable. It shows the general structure of the apparatus.
Figure 2:
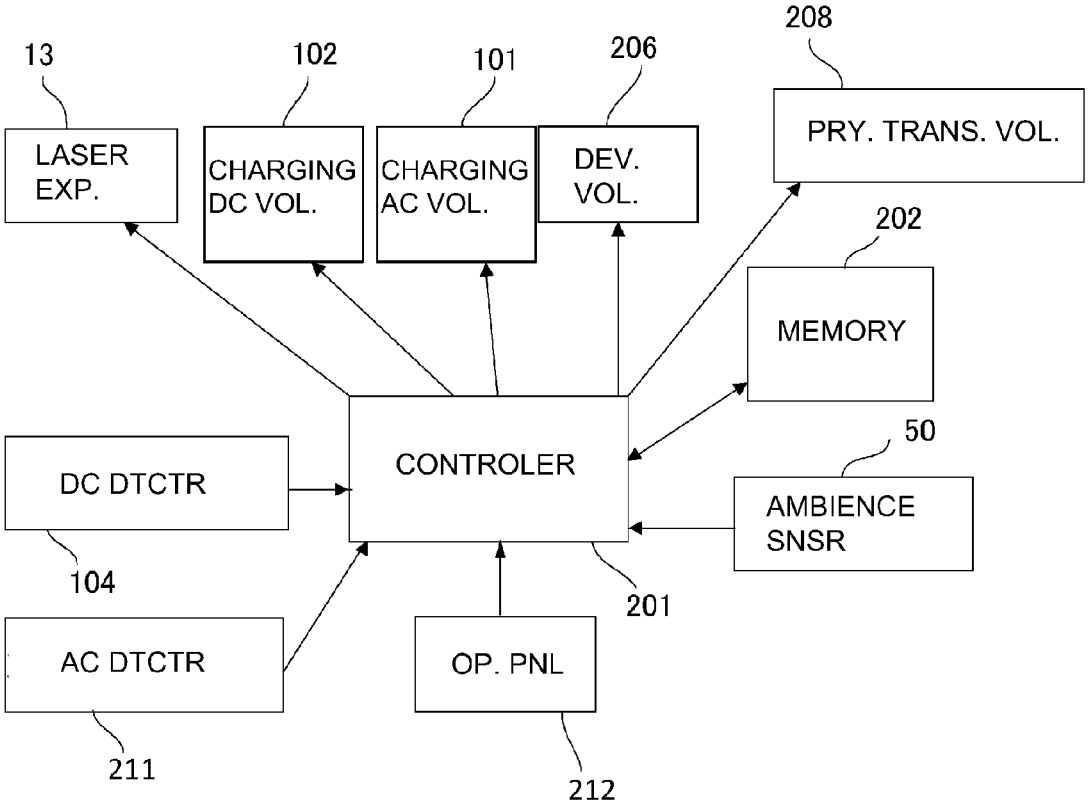
FIG. 2 is a block diagram of the control system of the image forming apparatus shown in FIG. 1.

FIG. 1 is a schematic sectional view of a typical electrophotographic image forming apparatus to which the present invention is applicable. It shows the general structure of the apparatus. FIG. 2 is a block diagram of the control system of the image forming apparatus shown in FIG. 1.

Referring to FIG. 1, the image forming apparatus 100 is a full-color printer of the tandem type, and also, of the intermediary transfer type. Thus, it has an intermediary transfer belt 31, and yellow, magenta, cyan and black image formation stations Pa, Pb, Pc and Pd which are aligned in tandem along the intermediary transfer belt 31.

In the image formation station Pa, a yellow toner image is formed on a photosensitive drum 11*a* as a photosensitive member, and is transferred onto the intermediary transfer belt 31. In the image formation station Pb, a magenta toner image is formed on a photosensitive drum 11*b* as a photosensitive member, and is transferred onto the intermediary transfer belt 31. In the image formation stations Pc and Pd, cyan and black toner images are formed on photosensitive drums 11*c* and 11*d* as photosensitive members, and are transferred, respectively, onto the intermediary transfer belt 31.

After the transfer of four monochromatic toner images, different in color, onto the intermediary transfer belt 31, the four toner images are conveyed to the secondary transfer station T2 by the movement of the intermediary transfer belt 31, and are transferred (secondary transfer) onto one of the sheets P of recording medium from a recording medium cassette 20. More specifically, the recording medium cassette 20 contains a substantial number of sheets P of recording medium. Each sheet P of recording medium in the cassette 20 is pulled out of the cassette 20 while being separated by a separation roller from the rest. Then, it is sent to a pair of registration rollers 23, which send the sheet P into the secondary transfer station T2 with the same timing as the timing with which the toner image on the intermediary transfer belt 31 arrives at the secondary transfer station T2.

After the transfer of the toner images, different in color, onto the sheet P of recording medium, the sheet P is separated from the intermediary transfer belt 31 by the curvature of the intermediary transfer belt 31, and is sent into a fixing device 40. The fixing device 40 has a fixation roller 41*a* and a pressure roller 41*b*. The fixation roller 41*a* has a halogen heater, as a heat source, which is in the hollow of the fixation roller 41*a*. The pressure roller 41*b* is on the underside of the fixation roller 41*a*, and is pressed upon the fixation roller 41, forming thereby a heating nip for heating a sheet P of recording medium and the toner image thereon. That is, the fixing device 40 fixes the unfixed toner image on a sheet of recording medium by applying heat and pressure to the sheet P and the toner image thereon while the sheet P is conveyed through the fixing device 40. Thereafter, the sheet P is discharged by a pair of discharge rollers 63 into a delivery tray 64, which is outside the main assembly of the image forming apparatus 100.

The image formation stations Pa, Pb, Pc and Pd are practically the same in structure although they are different in the color of the toner which their developing devices 14*a*, 14*b*, 14*c* and 14*d*, respectively, use. Therefore, they are described together as image formation stations P, that is, without showing the suffixes a, b, c and d.

The image formation station P has a photosensitive drum 11, which is a photosensitive member. It has also: a charge roller 12 which is a rotational charging member; an exposing device 13, a developing device 14; a primary transfer roller 35; and a drum cleaning device 15, which are positioned in the adjacencies of the peripheral surface of the photosensitive drum 11. The photosensitive drum 11 which is a photosensitive member is rotated in the direction indicated by an arrow mark at a preset process speed. The charge roller 12 uniformly charges the photosensitive drum 11 to a preset negative potential level VD, which will be the potential level of the unexposed portion of the peripheral surface of the photosensitive drum 11. The exposing device 13 writes an electrostatic image on the uniformly charged portion of the peripheral surface of the photosensitive drum 11. More specifically, the image to be formed is separated into four monochromatic images of four primary colors, one for one, and the information of the four monochromatic images of the primary colors, one for one, are turned into image formation data. Then, the uniformly charged portion of the peripheral surface of the photosensitive drum 11 is scanned by (exposed to) the beam of laser light emitted by the exposing device while being modulated (turned on or off) with the image formation data. Consequently, an electrostatic image of each monochromatic image of the primary color is effected on the peripheral surface of the photosensitive drum. The developing device 14 develops the electrostatic image on the peripheral surface of the photosensitive drum 11 into a visible image, that is, an image formed of toner, by supplying the peripheral surface of the photosensitive drum 11 with toner.

The primary transfer roller 35 forms the primary transfer station between the photosensitive drum 11 and intermediary transfer belt 13 by pressing the intermediary transfer belt 31 upon the peripheral surface of the photosensitive drum 11. As DC voltage is applied to the primary transfer roller 11, the tone image formed on the peripheral surface of the photosensitive drum 11 is transferred onto the intermediary transfer belt 31.

The drum cleaning device 15 is provided with a cleaning blade which is kept in contact with the peripheral surface of the photosensitive drum 11. Thus, as the photosensitive drum 11 is rotated, the transfer residual toner, that is, the toner remaining adhered to the peripheral surface of the photosensitive drum 11, on the downstream side of the primary transfer station, is rubbed by the cleaning blade, whereby the transfer residual toner is recovered by the drum cleaning device 15. The cleaning blade of the drum cleaning device 15 is positioned in such an attitude that its cleaning edge is on the upstream side of its base portion in terms of the moving direction of the peripheral surface of the photosensitive member. The dimension of the cleaning blade in terms of the direction parallel to the rotational direction of the photosensitive drum 11 is 8 mm. The cleaning blade is elastic, and is made of urethane. It is kept pressed upon the photosensitive drum 11 so that the linear contact pressure between the cleaning edge of the cleaning blade and the peripheral surface of the photosensitive drum 11 becomes roughly 35 g/cm.

The intermediary transfer belt 31 is suspended by a tension roller 33, a belt backing roller 34, and a belt driving roller 32, and is rotated in the direction indicated by an arrow mark R2 by the belt driving roller 32. The secondary transfer station T2 is the area of contact between the portion of the intermediary transfer belt 31, which is backed up by the belt backing roller 34, and the secondary transfer roller 35 pressed against the belt backing roller 34 with the presence of the intermediary transfer belt 31 between the two rollers 34 and 35. As DC voltage is applied to the secondary transfer roller 35, the toner image on the intermediary transfer belt 31 is transferred onto the sheet P of recording medium which is being conveyed through the secondary transfer station T2. The belt cleaning device 37 is provided with a cleaning blade. It recovers the contaminants such as the transfer residual toner and paper dust on the intermediary transfer belt 31 by placing the cleaning blade in contact with the surface of the intermediary transfer belt 31.

The photosensitive drum 11, charge roller 12, and drum cleaning device 15 are integrally placed in a cartridge, making up a process cartridge which is removably installable in the main assembly of the image forming apparatus 100. Thus, the photosensitive drum 11, charge roller 12, and cleaning device 15 can be replaced together as expendable supplies, by replacing the process cartridge. There are various types of process cartridge. Some of them are to be replaced by a professional service person, whereas the others may be replaced by an ordinary user. Here, an example of a process cartridge which can be replaced by an ordinary user, following the process cartridge replacement procedure displayed across the monitor with which the control panel of the main assembly of the image forming apparatus 100 is provided, is described.

Figure 4:
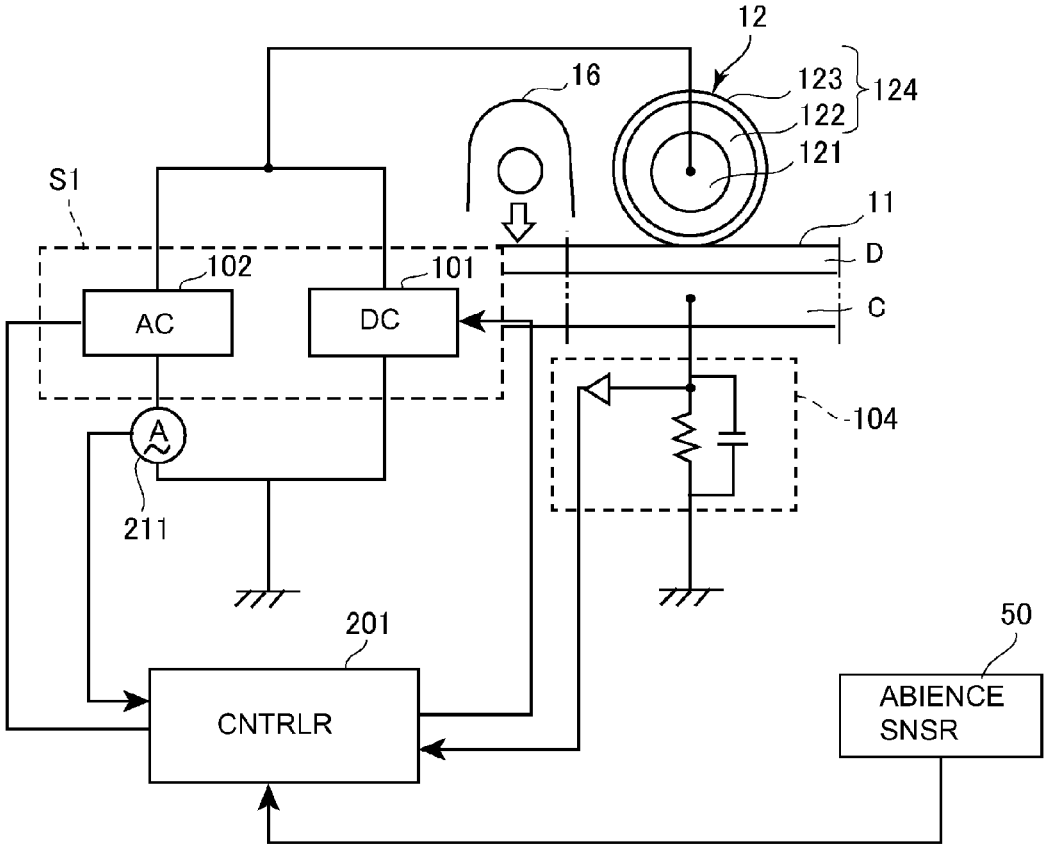
FIG. 4 is a schematic drawing of the charging system of the image forming apparatus shown in FIG. 1, which is for applying charge voltage to the charge roller of the apparatus. It shows the structure of the system.

Referring to FIG. 4, the control section 201 controls the image forming apparatus 100 in the image forming operation while integrally monitoring and controlling the various units of the apparatus 100.

The control section 201 is made up of a control chip for controlling the mechanism of each of the various units in operation, a motor driver chip (unshown), etc. An environment sensor 50 is placed in a position in which it can accurately measure the ambient temperature and humidity of the image forming apparatus 100, without being affected by the fixing device 40 and the like, which are heat sources in the apparatus 100. The control section 201 executes various control sequences based on the output (temperature and humidity levels) of the environment sensor 50.

A memory 202, which is a storage, stores information such as the referential current mount used in the operation for estimating the thickness of the photosensitive layer of the photosensitive drum 11, which will be described later. The control section 201 stores the information in the memory 202, and also, reads the information in the storage 202. A control panel 212 is provided with switches, monitors, etc., through which a user or a service person can operate the image forming apparatus 100. The control section 201 outputs such signals that make the information about the length of the residual life of the photosensitive member, for example, be displayed on the monitor.

<Photosensitive Drum>

Figure 3:
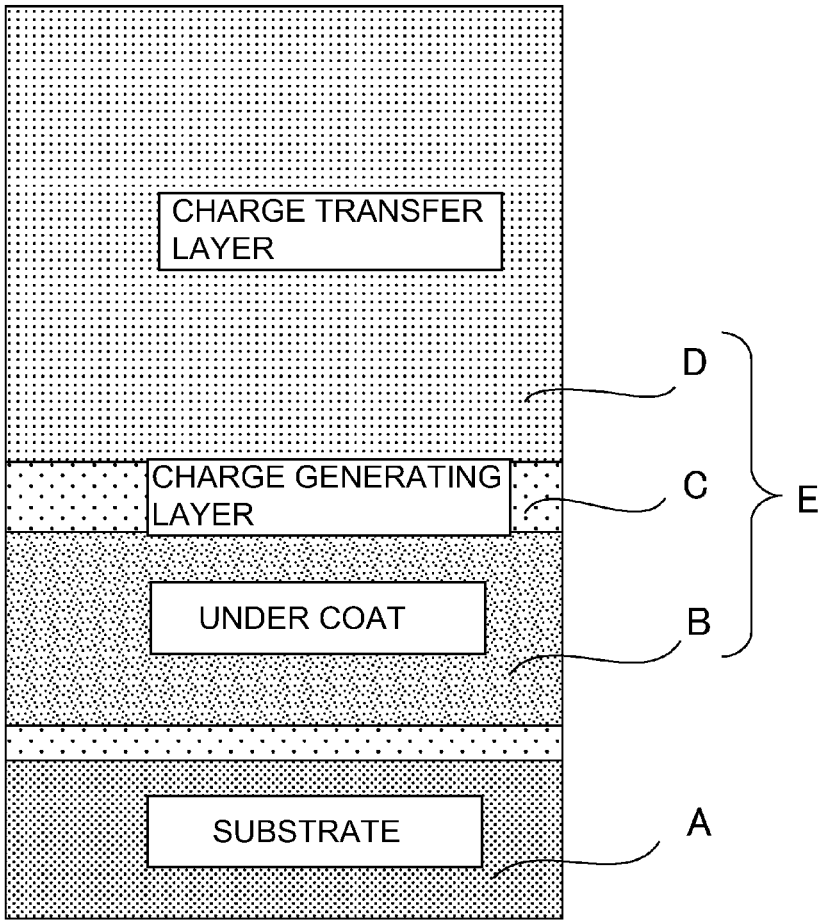
FIG. 3 is schematic sectional drawing of the photosensitive layer of the photosensitive drum of the image forming apparatus shown in FIG. 1. It shows the structure of the layer.

FIG. 3 is a schematic sectional view of the photosensitive layer of the photosensitive drum 11. It shows the structure of the layer. Referring to FIG. 3, the photosensitive drum 11 is made up of a substrate A and a photosensitive layer E. The substrate A is made of an aluminum cylinder. The photosensitive layer E covers virtually the entirety of the peripheral surface of the substrate A, and is made of negatively chargeable photo-conductor. It has a carrier generation layer which contains azoic pigment, and a carrier transfer layer made of a mixture of hydrazone and resin. It is a negatively chargeable organic semiconductor layer (OPC layer). The carrier transfer layer is layered on the carrier generation layer to a thickness of 29 μm.

The photosensitive layer (OPC layer) is an organic photosensitive layer, which is made up an undercoat layer B, a charge generation layer C, and an electric charge transfer layer D, which are layered on the peripheral surface of the substrate A in the listed order. It is in the form of a cylinder. There is no restriction regarding the material for the substrate A. That is, any metallic substance, for example, aluminum, copper, chrome, and nickel, and any metallic alloy, for example, stainless steel, can be used as the material for the substrate layer A, provided that it is electrically conductive and does not interfere with the process of measuring the thickness of the photosensitive layer.

The undercoat layer B is for improving the photosensitive drum 11 in the adhesion between the photosensitive layer and the substrate, and the coating of the photosensitive layer on the substrate layer A. It is also for protecting the substrate A, and covering the defects on the peripheral surface of the substrate A. Further, it is for improving the photosensitive drum 11 in the electrical charge injection from the substrate A, and also, for protecting the photosensitive layer from electrical destruction. As for the examples of the material for the undercoat layer B, there are polyvinyl alcohol, poly-N-vinylimidazole, polyethylene oxide, ethyl cellulose, ethylene-acrylic acid copolymer, casein, polyamide, N-methoxymethylate 6-nylon, nylon copolymer. The material may be glue or gelatine. These substances are to be dissolved in appropriate solvent, and coated on the substrate A. The undercoat layer B is desired to be in a range of 0.1 μm-2 μm in thickness.

In a case where a laminar photosensitive layer is made of the charge generation layer C, and the charge transfer layer D which is different in function from the charge generation layer C, the charge generation layer C is the first layer to be formed on the undercoat layer B; the charge transfer layer D is to be layered on the charge generation layer C. As for the substances which are usable as the material for the charge generation layer C, selenium-tellurium, pyrylium, dyes based on thiapyrylium pigment can be listed. Further, phthalocyanine compounds having various base metals and crystal system, more specifically, crystal system of α, β, γ or X type, anthoanthrone pigment, dibezopyrenequinone pigment, pyranthron pigment, trisazo pigment, and diazo pigment can also be listed. Further, monoazo pigment, indigo pigment, quinacridone pigment, unsymmetric quinocyanine, quinocyanine, and amorphous silicone disclosed in Japanese Laid-open Patent Application S54-143645 can also be listed. In the following embodiments of the present invention, in order to enable the image forming apparatus to output images of high quality, phthalocyanine compound which can provide a photosensitive layer higher in sensitivity was used as the material for the charge generation layer C.

In the case of the charge generation layer C of the laminar photosensitive layer, one of the abovementioned charge generation substances is dispersed in a combination of bonding resin which is 0.3-4 times in volume, and solvent, with the use of a homogenizer, a ultrasonic dispersing device, ball mill, vibration ball mill, sand mill, attritor, roll mill, or the like. Then, the mixture is coated on the undercoat layer B and dried. Or, one of the abovementioned charge generation substances is formed on the undercoat layer by vapor deposition or the like method. The charge generation layer C is desired to be no more than 5 μm in thickness, preferably in a range of 0.1-2.0 μm.

Substances usable as the abovementioned bonding resin are polymers and copolymers of vinyl compound such as styrene, vinyl acetate, vinyl chloride, ester acrylate, ester methacrylate, vinylidene fluoride, and trifluoroethylene. Further, polyvinyl alcohol, polyvinyl acetal, polyvinyl butyral, polycarbonate, polyester, polysulfone, polyphenylene oxide, polyurethane, cellulose resin, phenol resin, melamine resin, silicon resin, and epoxy resin are also usable.

The method for forming the charge transfer layer D is as follows. As proper charge transfer substances, hi-polymer compounds such as poly-N-vinylcarbazole, polystyrylanthracene, which have a heterocyclic or condensed polycyclic aromatic group can be listed. Further, heterocyclic compounds such as pyrazoline, imidazole, oxazole, triazole, and carbazole, can also be used as the material for the charge transfer layer D. Further, triaryl alkane derivative such as triphenyl methane is thinkable. Further, low-polymer compounds such as triallylamine derivative such as triphenyl amine, phenylene diamine derivative, N-phenylene carbazol derivative, stilbene derivative, and hydrazone derivative, can also be used. These substances can be used by dissolving/dispersing in a combination of proper bonding resin (similar to those mentioned in description of charge generation layer given above) and solvent.

The charge transfer layer D is formed by coating the above described solution on the charge generation layer D with the use of one of the abovementioned known methods, and drying the layer. In this case, the ratio of the charge transfer substance to the bonding resin is desired to be in a range of 20-100 in weight (assuming that overall weight be 100), preferably, in a range of 30-100 in weight. If the ratio of the charge transfer substance is no more than the abovementioned range, the charge transfer layer D will be insufficient in charge transfer performance, which results in the occurrence of such problem that the photosensitive layer is insufficient in sensitivity and/or undesirably high in residual potential level. The charge transfer layer D of the laminar photosensitive drum is desired to be in a range of 1-50 μm after the formation of a protective layer (including protective layer), preferably in a range of 3-30 μm. Here, the thickness of the charge transfer layer D is 29 μm.

<Charge Roller>

FIG. 4 is a drawing of the system for applying charge voltage to the charge roller 12. It shows the structure of the system. Referring to FIG. 4, the charge roller 12 is made up of a metallic core 121, and an elastic layer 124 formed on the peripheral surface of the metallic core 121. The elastic layer 124 is made up of two sublayers, that is, an electrical resistance adjustment layer 122, which is called "mid layer", and a surface layer 123 for preventing the mid layer from being contaminated by developer or the like.

The electrical resistance adjustment layer 122 is formed of thermoplastic resinous compound which contains high molecule ionic conductor as ion conducting agent. The volume specific resistivity of the electrical resistance adjustment layer 122 is desired to be in a range of $10^6$-$10^9$Ω·cm. If it is no less than $10^9$Ω·cm, the charge roller 12 is insufficient in charging performance and transfer performance. On the other hand, if it is no more than $10^6$Ω·cm, leakage occurs to the entirety of the photosensitive drum 11, which is attributable to current concentration.

It is preferred that the electrical resistance adjustment layer 122 is formed of thermoplastic resin such as polypropylene (PP), polymethyl methacrylate (PMMA), polystyrene (PS), copolymer (AS, ABS) of preceding substances, polyamide, and polycarbonate (PC). As the high molecule ionic conductor, which is to be dispersed in these thermoplastic resins is desired to be a high molecule compound which contains polyether-ester amide component.

Polyether-ester amide is high molecule ion conductor, and is uniformly dispersed in matrix polymer at a molecular level, and remains stable in position. Therefore, it does not suffer from nonuniformity in electrical resistance which is attributable to the imperfect dispersion of the ionic conductor, which occurs in the compound made by dispersing electron conductor such as metallic oxide and carbon black in the aforementioned thermoplastic resin.

Further, in a case where the material for the elastic layer 124, or the electrically conductive layer, of the charge roller 12 is a conductor of the electron conduction type, as high voltage is applied to the charge roller 12, passages through which electricity can easily flow are locally created, electric current leaks to the photosensitive drum 11, which results in the formation of abnormal images, more specifically, images which suffer from black and/or white spots. In comparison, polyether-ester amide is a high molecule substance, making it unlikely for "bleed out" to occur. Since the charge roller 12 has to have a preset amount of electrical resistance, it is necessary that the ratio of the thermoplastic resin is in a range of 20-70% in weight, and the ratio of the high molecule ion conductor is in a range of 80-20% in weight.

In addition, it is possible to add electrolyte (salt) in order to adjust the charge roller 12 in electrical resistance. As such salts, metallic salt of alkali metallic salt such as sodium perchlorate, lithium perchlorate, etc., lithium imide salt such as lithium bisimide, lithium trisimide, etc., quaternary phosphonium salt such as ethyltriphenyl phosphonium, tetrafluoroborate, and tetraphenylphosphonium bromide, can be listed. Conductive substances may be used alone or in mixture within a range in which they do not alter in properties.

In order to uniformly disperse, at a molecular level, the conductive substance in the matrix polymer, compatibility accelerator may be added. Addition of compatibility accelerator enables the conductive substance to microscopically disperse. Compatibility accelerator agent may be used as necessary. As the compatibility accelerator, a substance having glycydil methacrylate radicals as reactive radicals can be listed. Further, such an additive as oxidization inhibitor or the like may be used. There is no restriction regarding the production method for the resinous compounds. That is, they can be easily manufacture by mixing the materials, and melting and kneading the mixture with two-shaft kneading machine or the like. Further, the electrical resistance adjustment layer can be easily formed on the peripheral surface of the electrically conductive component (metallic core) by covering the conductive component with the conductive resinous compound by an extruding means, an ejecting means, or the like.

In this embodiment, the volume specific resistivity of the surface layer is made to be greater than that of the electrical resistance adjustment layer, because making the surface layer greater in volume specific resistivity than the electrical resistance adjustment layer can prevent the problem that voltage concentrates to the defective portions of the photosensitive drum 11 and/or abnormal electrical discharge occurs. However, making the surface layer excessively high in electrical resistance results in the production of a charging roller which is insufficient in charging performance. Therefore, the difference in the amount of electrical resistance between the surface layer and electrical resistance adjustment layer is desired to be no more than $10^3\Omega\cdot cm$.

The substances which are suitable as the material for the surface layer, fluorinated resin, silicone resin, polyamide resin, polyester resin, and the like are desirable because they are very nonadhesive, and therefore, the surface layer formed of these materials is very easy to clean. As for the method for forming the surface layer on the electric resistance adjustment layer, the abovementioned materials for the surface layer are to be dissolved in organic solvent so that they can be coated on the electric resistance adjustment layer like paint, with the use of any of various coating methods, for example, spraying, dipping, roller coating, etc. The surface layer is desired to be in a range of 10-30 μm in thickness.

The material for the surface layer may be either of the single or two liquid types. However, the paintable form which uses hardener can yield a charge roller which is superior in terms of resistance to the ambience, nonadhesiveness, and parting properties. In a case where the materials for the surface layer are turned into paint, it is common practice to heat the surface layer to make the resin bridge and harden. However, the electrical resistance adjustment layer is formed of thermoplastic resin. Therefore, it cannot be heated at a high level of temperature. In a case of the two-liquid paint, it is effective to use the primary ingredient, the molecules of which have hydroxyl group, and isocyanate resin which bridges with hydroxyl group. Isocyanate resin enables bridging/hardening reaction to occur at a relatively low level of temperature, that is, at a temperature level no higher than 100° C. It has been confirmed based on the studies made regarding the nonadhesiveness of toner, that the silicone resin, in particular, acrylic silicone resin, the molecules of which have an acrylic skeleton, is superior in terms of nonadhesiveness.

In the case of a charging member (rotational charging member as charge roller 12), its electrical properties (electrical resistance value) are important. Therefore, the surface layer of the charge roller 12 has to be electrically conductive. One of the methods for making electrically conductive, the surface layer formed of dielectric material, is to disperse electrically conductive substance in the resinous substance as one of the materials for the surface layer. There is no restriction about the electrically conductive agent. For example, kechen black 5:36 listing of Chemical names.

<Voltage Application Circuit>

Referring to FIG. 4, as oscillating voltage, which is a combination of a DC voltage Vdc and an AC voltage Vac which is f Hz in frequency is applied to the charge roller 12 from an electric power source S1 through the metallic core 121, the peripheral surface of the rotating photosensitive drum 11 is charged to a preset potential level. The power source S1 has a DC power source 101 and an AC power source 102.

The control section 201 can turn on or off one, or both, of the DC power source 101 and AC power source 102 of the power source S1 to apply to the charge roller 12 one or both of the DC and AC voltage. The control section 201 controls in voltage value the DC voltage Vdc applied to the charge roller 12 from the DC power source 101, and the peak-to-peak voltage value of the AC voltage applied to the charge roller 12 from the AC power source 102.

The environment sensor 50 is a sensor for detecting the temperature and humidity of the environment in which the image forming apparatus 100 is being operated. The information about the ambience of the image forming apparatus 100, which is obtained by the environment sensor 50, is inputted into the control section 201. More specifically, the information about the ambience of the image forming apparatus 100 to be inputted into the control section 201 is about the ambient temperature and relative humidity.

The control section 201 calculates the absolute amount of moisture from the inputted temperature and relative humidity, and determines the settings for the charge voltage, development voltage, transfer voltage, etc. Setting charging voltage means setting a value for the DC voltage of the oscillating voltage, and a value for the peak-to-peak voltage Vpp of the AC voltage of the oscillating voltage.

An alternating current measurement circuit 211 measures the amount of the alternating current which flows to the charge roller 12 through the photosensitive drum 11. The alternating current amount measured by the alternating current measurement circuit 211 is inputted into the control section 201. The control section 201 determines the charging setting which is appropriate for the ambience of the main assembly of the image forming apparatus 100, and changes in amount the peak-to-peak voltage Vpp of the AC voltage of the oscillating voltage to be applied during an image forming operation, according to the condition of the ambience of the image forming apparatus 100. That is, the control section 201 executes a program for computing, determining, and setting a proper amount for the peak-to-peak voltage Vpp of the AC voltage to be applied to the charge roller 12 during an image forming operation.

Instead of an operation sequence (control sequence), such as the above described one, for keeping constant the AC voltage, an operation sequence which keeps constant the total amount of current Iac which flows to the charge roller 12 during an image forming operation may be used. The total amount of alternating current Iac is the sum of the amount of nip current R·Vpp and amount of discharge current ΔIac.

However, the operation which keeps the alternating current constant controls not only the amount ΔIac of the discharge current which is necessary to charge the photosensitive drum 11, but also, the total amount of current Iac which includes the nip current R·Vpp. Thus, it does not accurately control the amount ΔIac of discharge current. When the total amount of current is kept constant, the reduction in the amount of electrical resistance of the materials for the charge roller 12 increases the amount of the nip current R·Vpp, reducing thereby the amount ΔIac of the discharge current. Therefore, it is impossible to control the amount ΔIac of the discharge current in increase or decrease, with the use of the method for keeping constant the amount of the electrical current flowed by the AC voltage. From the standpoint of extending the photosensitive drum 11 in service life, it is impossible to uniformly charge the photosensitive drum 11 while preventing the photosensitive drum 11 from being shaved by the charge roller 12.

<Method for Controlling AC Voltage>

Figure 5:
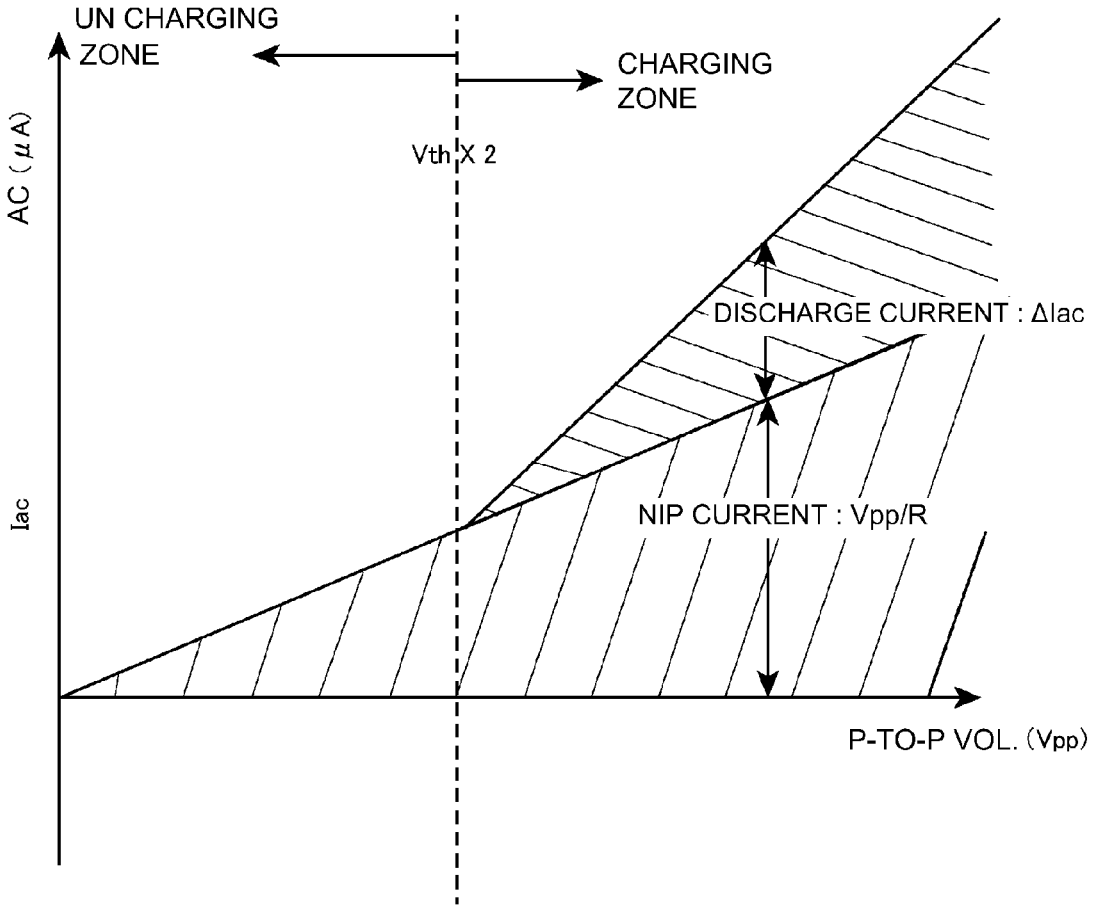
FIG. 5 is a graph which shows the relationship between the amount of the AC voltage applied to the charge roller and the amount of the alternating current flowed by the AC voltage.

FIG. 5 is a graph which shows the relationship between the amount of the AC voltage applied to the charge roller 12 and the amount of the alternating current flowed by the AC voltage. In the case of the charging method which charges the photosensitive drum 11 by applying oscillating voltage to the charge roller 11, DC voltage is combined with AC voltage. Therefore, the peripheral surface of the photosensitive drum 11 is uniformly charged while electrical discharge alternately occurs from the charge roller to the photosensitive drum, and from the photosensitive drum to the charge roller. The amount of the DC voltage applied to the charge roller 12 for the normal image forming operation is determined based on the proper settings determined through the process for controlling the image forming apparatus in image density. Therefore it is randomly affected by the ambient temperature and humidity of the image forming apparatus 100, cumulative number of images (prints) outputted by the image forming apparatus 100, and the like factors. Therefore, in order to keep the photosensitive drum 11 stable in the potential level to which its peripheral surface is to be charged, the amount of the AC voltage to be applied for the normal image forming operation is desired to be set to twice the amount of the DC voltage applied to the charge roller 12. Thus, the amount of the AC voltage to be applied to the charge roller 12 for the normal image formation operation is periodically reset through a process through which the charging device is controlled in the amount of discharge current.

In the case of a charging method which uses AC voltage, the relationship between the amount Vc of the AC voltage to be applied to the charge roller 11 and the amount Ic of the alternating current which flows to the charge roller 11 is not always stable. That is, it is affected by the thickness of the photosensitive layer of the photosensitive drum 11, cumulative length of time electricity has bee flowed through the charge roller 12, ambient temperature and humidity, etc. For example, as the photosensitive layer becomes thinner due to abrasion, alternating current is likely to increase even if the AC voltage remains the same. Further, as the charge roller 12 is continuously used for a substantial length of time, it increases in the amount of electrical resistance, being therefore likely to reduce in the amount of alternating current even if the AC voltage remains the same.

Moreover, in an environment in which temperature and humidity are low (L/L), the material of which the charge roller 12 is made is likely to dry, and therefore, it becomes difficult for electrical discharge to occur between the charge roller 12 and photosensitive drum 11. Therefore, the AC voltage is increased in peak-to-peak voltage Vpp (amplitude) in order to ensure that the photosensitive drum 11 is uniformly charged. On the contrary, in an environment which is high in temperature and humidity (H/H), the material of which the charge roller 12 is made absorbs moisture. Therefore, the AC voltage is reduced in peak-to-peak voltage Vpp in order to prevent the discharge current from becoming excessive. Thus, in order to ensure that an image forming apparatus continuously outputs high quality images for a long period, the peak-to-peak voltage Vpp of the AC voltage to be applied to the charge roller 12, and the amount of the direct current which flows through the charge roller 12, have to be continuously adjusted to prevent the occurrence of the excessive electrical discharge to ensure that the peripheral surface of the photosensitive drum 11 is uniformly charged.

Referring to FIG. 4, in the case of the image forming apparatus 100, the amount of the alternating current is measured while changing in several steps the AC voltage to be applied to the charge roller 11, and a control sequence for determining a proper amount for the peak-to-peak voltage Vpp of the AC voltage, which is necessary to flow a preset amount of discharge current during an image forming operation, is carried out.

Referring to FIG. 5, when the peak-to-peak voltage Vpp is in a range in which the electrical discharge does not occur, that is, when it is smaller than the discharge start voltage Vth×2 (V), the relationship between the peak-to-peak voltage Vpp and alternating current amount Iac is roughly linear. However, when the peak-to-peak voltage Vpp is in a range in which the electrical discharge occurs, that is, when it is no less than Vth×2 (V), the alternating current amount Iac gradually increases, compared to the linear relation between the peak-to-peak voltage Vpp and alternating current amount Iac in the range in which no electrical discharge occurs.

In a case where the above described control sequence was carried out in a vacuum chamber in which electrical discharge does not occur, the abovementioned linear relationship in the electric discharge range is the same as the linear relationship in the no electric discharge range. Thus, it is reasonable to think that the difference ΔIac (increase) is attributable to the electrical discharge. Thus, when the inclination of the linear relationship in the no-discharge range is R (peak-to-peak voltage Vpp/AC voltage Iac), the amount of the nip current which flows through the area of contact between the charge roller 12 and photosensitive drum 11 is R·Vpp. Here, the difference in amount between the measured total amount of alternating current Iac and the nip current R·Vpp is defined as the discharge current amount ΔIac:

$$\Delta Iac = Iac - R \cdot Vpp \qquad \text{Equation 1.}$$

The discharge current amount ΔIac represents the actual amount of AC discharge, and has close relationship to the abrasion of the photosensitive drum, "image deletion", and level of uniformity at which the peripheral surface of the photosensitive drum 11 is charged. The discharge current amount ΔIac is affected by the changes in the temperature and humidity. It is also affected by the cumulative number of images formed by the image forming apparatus 100. The relationship between the peak-to-peak voltage Vpp and discharge current amount ΔIc, and the relationship between the alternating current amount Iac and discharge current amount ΔIac, are affected by the changes in the ambient temperature and humidity, and the cumulative number of the images outputted by the image forming apparatus 100.

If the discharge current amount Δiac is excessive small, the photosensitive drum 11 is nonuniformly charged, which is likely to cause the image forming apparatus 100 to output images which suffer from defects attributable to nonuniform charging of the photosensitive drum 11, for example, images which are nonuniform across their halftone areas, images which have an appearance of sandy ground, images which are foggy across their while areas, and the like. On the other hand, if the discharge current amount Δiac is excessively large, byproduct of electric discharge makes the image forming apparatus to suffer from "image deletion", that is, a phenomenon that byproducts of electrical discharge causes electrical charge to leak from an electrostatic image, which in turn makes it likely for the image forming apparatus 100 to output defective images, more specifically, images which give an impression of flowing water.

In the case of the image forming apparatus 100, therefore, each time it is put through the preparatory process in which the photosensitive drum 11 is idly rotated multiple times, a proper amount for the peak-to-peak voltage Vpp of the AC voltage, which is necessary to cause the discharge current to flow by a preset amount D during an image forming operation, is experimentally obtained. Then, in an actual image forming operation, the AC voltage is controlled so that its peak-to-peak voltage Vpp remains stable at the experimentally obtained level. This method is used to absorb the fluctuation in the amount of the electrical resistance, of the charge roller 12, which is attributable to the variations which occurs to the properties of the charge roller 12 during the manufacturing of the charge roller 12, changes in properties which occurs to the materials of the charge roller 12 due to the changes in the environment in which the image forming apparatus 100 is operated, and also, the fluctuation in the output of the power source 102.

Moreover, during an image forming operation in which a substantial number of images (prints) are continuously outputted, the amount of the alternating current which flows while an image is actually formed, and the amount of the alternating current which flows when AC voltage, the peak-to-peak voltage Vpp of which is in the no-discharge range, is applied to the charge roller 12, were measured, for every image interval, in order to adjust in peak-to-peak voltage Vpp the AC voltage to be applied to the charge roller 12 during the following image forming operation. In other words, the AC voltage to be applied to the charge roller 12 is adjusted for each image (print). Therefore, even if the charge roller 12 changes in the amount of electrical resistance during a continuous image forming operation, it is assured that the discharge current amount ΔIac is kept at a present level.

Further, the control section 201 calculates the absolute amount of moisture in the air in the main assembly of the image forming apparatus 100, based on the temperature and humidity measured by the environment sensor 50. Then, it changes the setting for the discharge current amount, in response to the absolute amount of humidity. In an environment which is relative large in the absolute amount of moisture, the image forming apparatus 100 is likely to suffer from "image deletion". However, it is unlikely for the photosensitive drum 11 to be undercharged. Therefore, the discharge current amount ΔIac is set to an extremely small value. On the other hand, in an environment which is smaller in the absolute amount of moisture, the image forming apparatus 100 is unlikely to suffer from "image deletion". However, the photosensitive drum 11 is likely to be undercharged. Therefore, the discharge current amount ΔIac is set to a slightly larger value. Thus, the image forming apparatus 100 is prevented from outputting defective images, the defects of which are attributable to the undercharging of the photosensitive drum 11, while being prevented from suffering from "image deletion". However, even if the discharge current amount Δiac is set to a proper value, there occurs a situation in which the image forming apparatus 100 is likely to suffer from "image deletion". More concretely, in a case where a substantial number of images which are small in the amount of toner consumption are continuously formed, and/or case where the photosensitive drum 11 is rotated multiple times for starting up the image forming apparatus 100 while the apparatus 100 is kept in the sleep mode, the image forming apparatus 100 reduces in the amount by which developer (which functions as abrasive) is supplied to the cleaning blade. Consequently, the cleaning blade reduces in its ability to remove the electrical discharge byproducts having adhered to the peripheral surface of the photosensitive drum 11, making it likely for the image forming apparatus 100 to suffer from "image deletion".

<Operational for Estimating Thickness of Photosensitive Layer>

Figure 6:
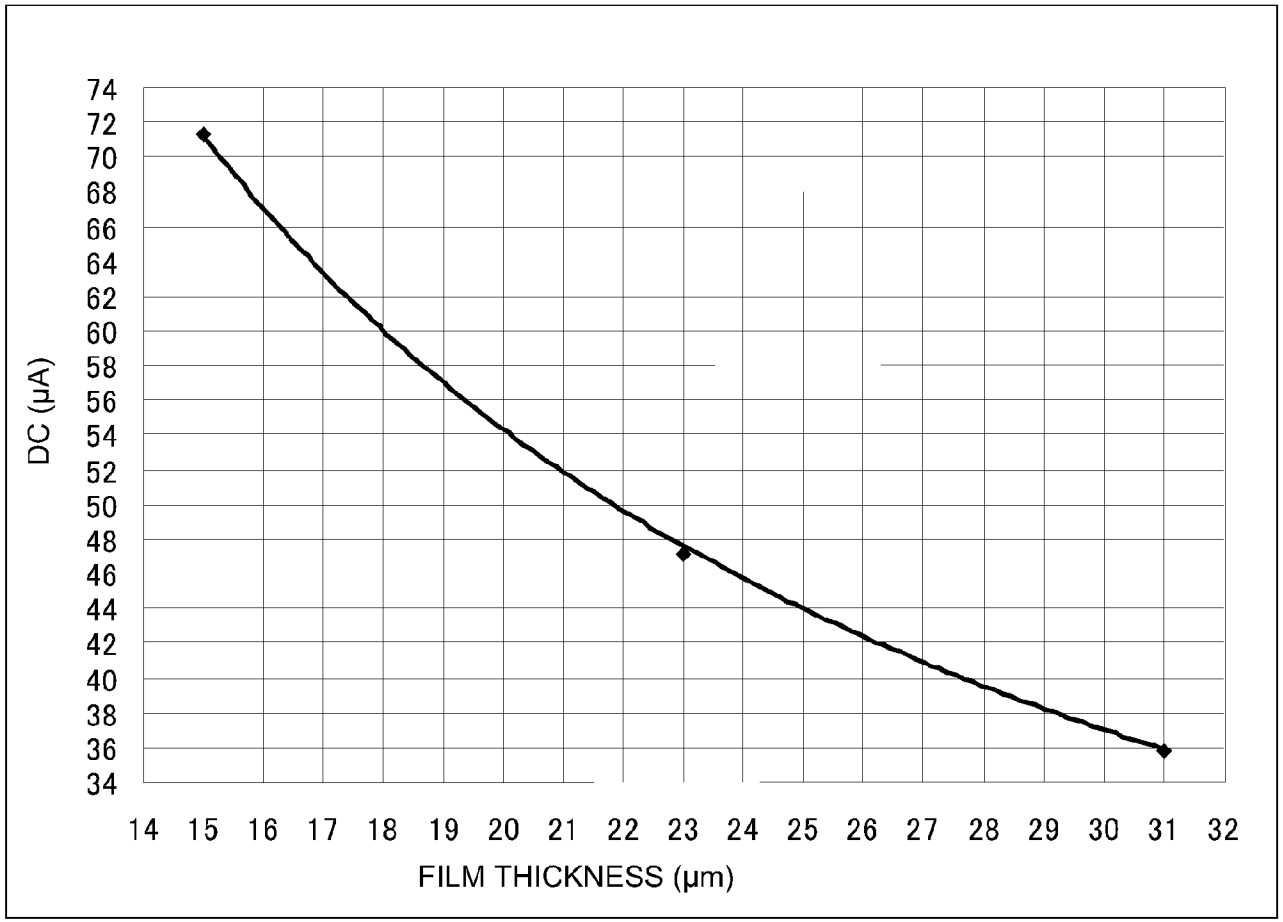
FIG. 6 is a graph which shows the relationship between the amount of the direct current which flowed between the charge roller and photosensitive member, and the thickness of the photosensitive layer of the photosensitive member.
Figure 7:
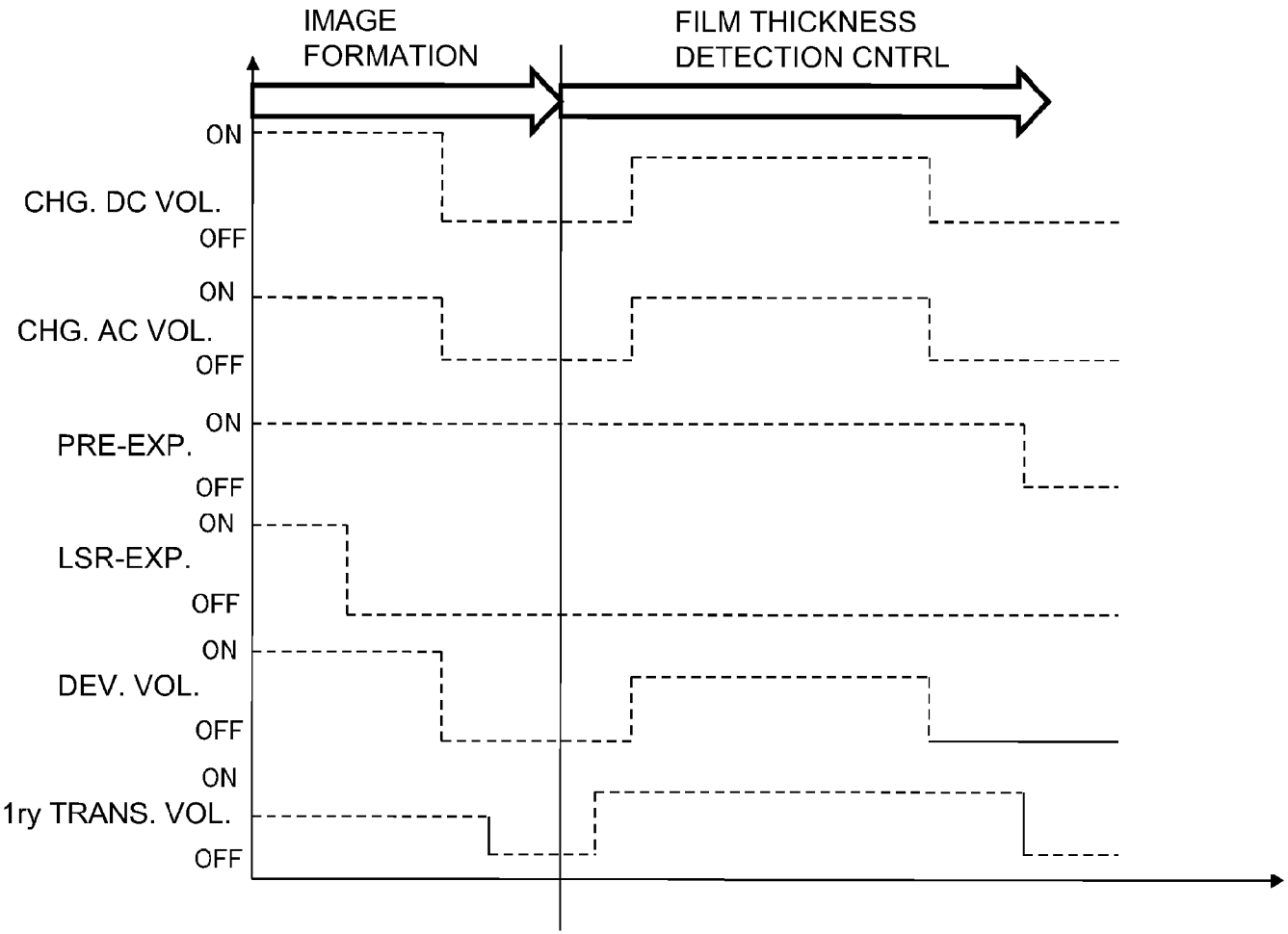
FIG. 7 is a timing chart for the voltage control timing in the operation for estimating the thickness of the photosensitive layer.

FIG. 6 is a graph which shows the relationship between the amount of DC voltage flowed while the photosensitive drum 11 was charged, and the thickness of the photosensitive layer of the photosensitive drum 11. FIG. 7 is a timing chart for the operational for estimating the thickness of the photosensitive layer.

Referring to FIG. 1, the cleaning device 15 cleans the peripheral surface of the photosensitive drum 11 by shaving away the byproducts of electrical discharge having adhered to the peripheral surface of the photosensitive drum 11. However, in order to quickly remove the byproducts electrical discharge, it slightly shaves away the photosensitive layer of the photosensitive drum 11, along with the byproducts of electrical discharge while cleaning the photosensitive drum 11. Further, during an image forming operation, the surface of the photosensitive layer is subjected to the electrical discharge caused by the AC voltage, being thereby made to evaporate and/or spattered away by a minute amount. That is, the photosensitive drum 11 is made to deteriorate by the electrical discharge between the charge roller 12 and photosensitive drum 11, shaving of its peripheral surface by the cleaning, and/or the like causes. In other words, as the image forming apparatus 100 increases in the cumulative number of the images it forms, the photosensitive layer of the photosensitive drum 11 gradually reduces in thickness by being subjected to the electrical discharge which occurs between the charge roller 12 and photosensitive drum 11, and also, being rubbed by the cleaning blade.

Referring to FIG. 2, the control section 201 estimates the thickness of the photosensitive layer of the photosensitive drum 11 by measuring the amount of the direct current which flows between the charge roller 12 and photosensitive drum 11 when the photosensitive drum 11 is charged by the charge roller 12. The control section 201 calculates the length of the residual life of the photosensitive drum 11 from the estimated thickness of the photosensitive layer. Then, not only does it output a signal for displaying the length of the residual life of the photosensitive drum 11 on the monitor of the control panel 212 of the image forming apparatus 100, but also, changes the image forming apparatus 100 in the image formation settings according to the estimated thickness of the photosensitive layer.

As the photosensitive layer of the photosensitive drum 11 reduces in thickness, the surface of the photosensitive drum 11 increases in electrostatic capacity, which in turn increases in the amount of direct current necessary to charge the discharged photosensitive drum 11 to a preset potential level. Therefore, how much the photosensitive layer is reduced in thickness can be estimated by measuring the amount of direct current which flows between the charge roller 12 and photosensitive drum 11 while the photosensitive drum 11 is charged by the charge roller 12.

As the photosensitive layer of the photosensitive drum 11 reduces in thickness, the image forming apparatus 100 is likely to output defective images, such as streaky images, and images which are nonuniform in appearance, the defects of which are attributable to the shaving of the photosensitive drum 11. Thus, the control section 201, predicts from the thickness of the photosensitive layer, the point in time when the photosensitive drum 11 reaches the end of its life, and outputs signals for displaying the predicted point in time, on the monitor of the control panel 212.

Referring to FIG. 4, the charge roller 12 which is a rotational charging component, is placed in contact with the peripheral surface of the photosensitive drum 11, and is given an oscillating voltage, which is a combination of DC and AC voltages, by the power source S1. The thickness of the photosensitive layer of the photosensitive drum 11 is estimated based on the amount of the direct current which flows into the photosensitive drum 11 from the charge roller 12 when the peripheral surface of the photosensitive drum 11 is charged to a preset potential level.

There is provided between the photosensitive drum 11 and ground, a direct current detection circuit 104, which is a current detecting section for estimating the thickness of the photosensitive drum 11. The direct current measurement circuit 104 has a resistor R for measuring the amount of direct current which flows from the charge roller 12 to the photosensitive drum 11, a capacitor C for bypassing the alternating current, and an amplification circuit A.

The control section 201 measures the voltage between the terminals of the resistor R, and estimates the thickness of the photosensitive layer of the photosensitive drum 11 based on the measured amount of the voltage.

Next, referring to FIG. 6, as the photosensitive layer of the photosensitive drum 11 is abraded, and therefore, reduces in thickness, the amount of the direct current, which is detected by the direct current measurement circuit 104, increases. The phenomenon that as the photosensitive drum 11 reduces in the thickness of its photosensitive layer, it increases in the amount by which direct current flows into the photosensitive drum 11, is widely used to calculate the length of the residual life of the photosensitive drum 11 based on the estimated thickness of the photosensitive layer of the photosensitive drum 11. Thus, the limit of the process cartridge, in terms of the point in time when a process cartridge, which includes a photosensitive drum, will begin to make the image forming apparatus 100 output unsatisfactory images, can be accurately predicted by detecting the changes in the thickness of the photosensitive layer of the photosensitive drum 11.

Referring to FIG. 7, the operation for estimating the thickness of the photosensitive layer of the image forming apparatus 100 is carried out right after the photosensitive drum 11 in the image forming apparatus 100 is rotated multiple times during the startup of the image forming apparatus 100 after the main power source of the image forming apparatus 100 is turned on. After the image forming apparatus 100 is started up, the thickness of the photosensitive layer is estimated every preset number (1,000, for example) of images which the image forming apparatus 100 forms, by interrupting the ongoing image forming operation. However, from the standpoint of productivity, it may be only at the end of the preparatory idling of the image forming apparatus 100 that the thickness of the photosensitive layer is estimated, or the preset ordinal number for images, at which the thickness of the photosensitive layer is to be estimated, may be adjusted according to the various conditions which affect the rate at which the photosensitive layer is reduced in thickness, in order to minimize the frequency with which the thickness of the photosensitive layer is estimated.

The relationship between the thickness of the photosensitive layer of the photosensitive drum 11 and the amount of the direct current is affected by the materials of the photosensitive drum 11, potential level of the photosensitive drum 11 before the photosensitive drum 11 is charged, peripheral velocity (process speed) of the photosensitive drum 11, and the like factors. Therefore, the operation for estimating the thickness of the photosensitive layer of the photosensitive drum 11 is carried out by presetting these factors. Changes in the potential level of the photosensitive drum 11 substantially affect the amount of the direct current. Therefore, the DC voltage to be applied to the charge roller 12 is kept stable at a preset level in order to keep the photosensitive drum 11 stable in potential level.

In order to make the peripheral surface of the photosensitive drum 11 uniform in potential level, the control section 201 increases the pre-exposure device 16 in its output for erasing the residual electrostatic image on the peripheral surface of the photosensitive drum 11 during the normal image forming operation, so that the peripheral surface of the photosensitive drum 11 becomes uniform in potential level after the removal of the electric charge from the peripheral surface of the photosensitive drum 11. An exposing device which is very high in light output is selected as the pre-exposure device 16 so that the electrical charge is fully removed from the peripheral surface of the photosensitive drum 11. Generally, the pre-exposure device 16 is desired to be in a range of 10-50 μW in exposure light intensity. Here, the output of the pre-exposure device 16 is set to 30 μW.

Instead of removing the electric charge of the photosensitive drum 11 by the pre-exposure device 16, it is possible to apply positive voltage to the primary transfer roller (35 in FIG. 1) to discharge the peripheral surface of the photosensitive drum 11. In either case, if the peripheral surface of the photosensitive drum 11 will not have been discharge before it reaches the charge roller 12, it is impossible to reliably detect the amount of the direct current. Therefore, in order to reliably detect the amount of the direct current, the photosensitive drum 11 is to be pre-exposed so that its surface potential will reduce to virtually 0 V.

Further, in order to prepare the image forming apparatus 100 for the measurement of the direct current, the control section 201 sets the amount of the DC voltage to be applied to the charge roller 12, to a preset value, which is different from the value to which it is set for the normal image forming operation. Further, the control section 201 sets the AC voltage to be applied to the charged roller 12, in combination with the DC voltage, to a preset voltage which also is different from the value to which it is set during the normal image forming operation.

Referring to FIG. 7, before the control section 201 starts controlling the image forming apparatus 100 to estimate the thickness of the photosensitive layer of the photosensitive drum 11, it turns off the photosensitive drum charging DC voltage (which will be referred to simply as drum charging DC voltage, hereafter), photosensitive charging AC voltage (which will be referred to simply as drum charging AC voltage, hereafter), development voltage, and primary transfer voltage, in the listed order. After it has turned off all the voltages, it turns on the primary transfer voltage, drum charging DC voltage, drum charging AC voltage, and development voltage, in the listed order. In order for the drum charging DC voltage and drum charging AC voltage to be able to keep the potential of the peripheral surface of the photosensitive drum 11 at a preset level, they have to be applied in combination. Therefore, they are turned on with roughly the same timing. The pre-exposure device 16 is kept turned on throughout the operation for estimating the thickness of the photosensitive layer of the photosensitive drum 11.

The development voltage begins to be applied at about the same time as the drum charging DC voltage and drum charging AC voltage, in order to keep the difference in potential level between the photosensitive drum 11 and development sleeve 14*s* (FIG. 1) during the operation for estimating the thickness of the photosensitive layer of the photosensitive drum 11, the same as that during the normal image forming operation, in order to prevent the unwanted developer from adhering to the photosensitive drum 11. If the fog prevention contrast Vback, that is, the difference in potential level between the unexposed portions of the peripheral surface of the photosensitive drum 11 and the development sleeve 14*s*, becomes excessively large, the carrier in the developer adheres to the photosensitive drum 11. Incidentally, the adherence of the carrier to the photosensitive drum 11 can be prevented to a certain degree by keeping the development sleeve 14*e* stationary and not applying development voltage to the development sleeve 14*e*.

Referring to FIG. 4, it is not mandatory that the direct current measurement circuit 104 is positioned between the photosensitive drum 11 and ground. For example, the direct current measurement circuit 104 may be positioned between the charge roller 12 and power source S1, or between the power source S1 and ground.

<Comparative Operation 1 for Estimating Thickness of Photosensitive Layer>

Figure 8:
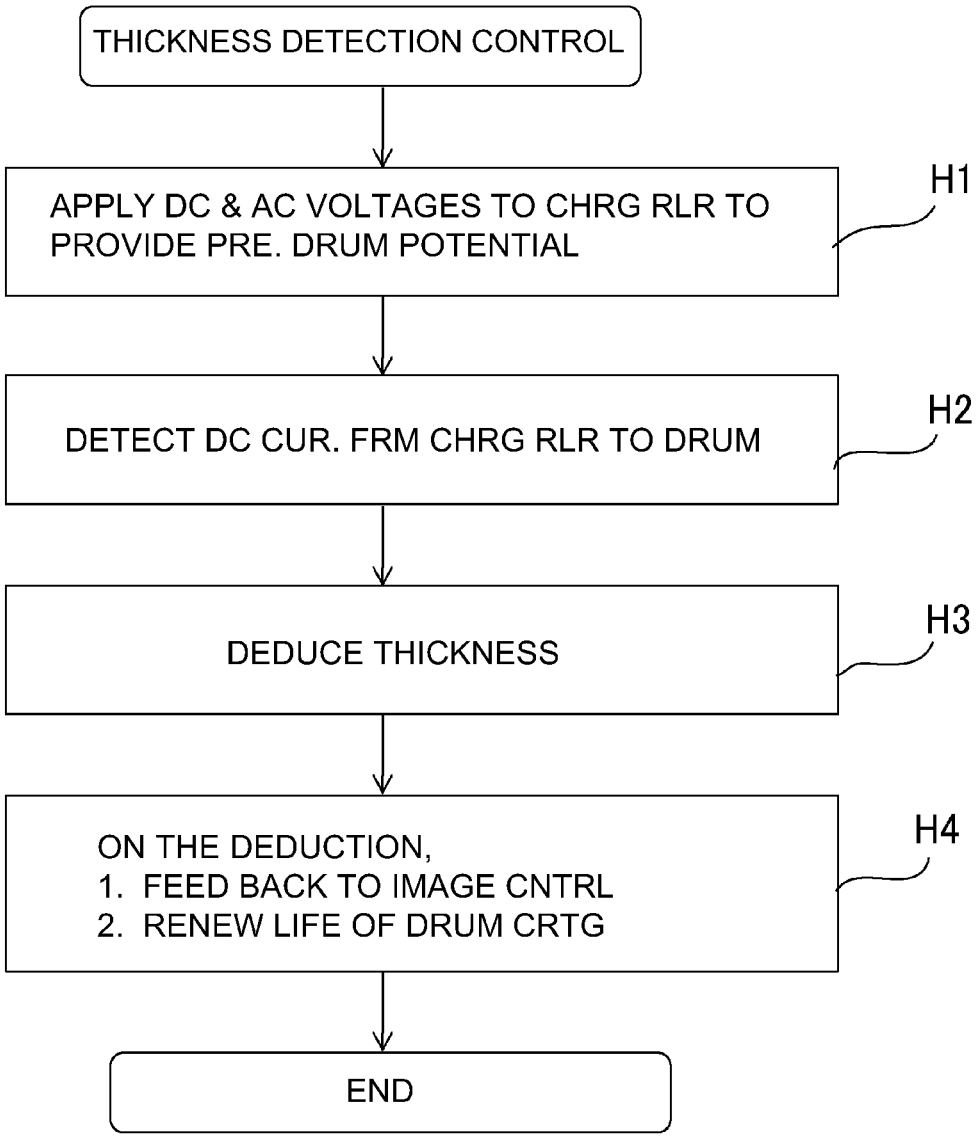
FIG. 8 is a flowchart of the first comparative operation for estimating the thickness of the photosensitive layer.

FIG. 8 is a flowchart for the first comparative operation for estimating the thickness of the photosensitive layer of the photosensitive drum 11. The first one is the conventional operation for estimating the thickness of the photosensitive layer of the photosensitive drum 11.

Referring to FIG. 8 along with FIG. 4, the control section 201 controls the power source S1 to apply a preset oscillating voltage, that is, a combination of a preset DC voltage, and AC voltage preset in peak-to-peak voltage, to the charge roller 12 (H1). Then, the control section 201 takes in the output of the direct current measurement circuit 104, and obtains (calculates) from the output, the amount of direct current which flows from the charge roller 12 into the photosensitive drum 11 (H2). Then, the control section 201 estimates the thickness of the photosensitive layer of the photosensitive drum 11 from the obtained amount of the direct current, with reference to the direct current amount/thickness of photosensitive layer of photosensitive drum conversion table in FIG. 10 (H3). Then, the control section 201 feeds back the estimated thickness of the photosensitive layer of the photosensitive drum 11 to the image formation apparatus settings for the normal image forming operation, and displays the newest estimation of the length of the residual life of the drum cartridge, on the monitor of the control panel 212 (H4).

Generally speaking, as the photosensitive drum 11 reduces in the thickness of its photosensitive layer, the image forming apparatus 100 improves in developmental performance. Thus, the image forming apparatus 100 is desired to be reduced in the difference in potential level between the exposed and unexposed areas of the peripheral surface of the photosensitive drum 11, that is, the so-called latent image contrast, which is determined by the drum charging DC voltage, intensity of laser light, etc. Therefore, it is common practice to reduce the drum charging DC voltage and/or reduce the exposing device 13 in output, as the photosensitive drum 11 reduces in the thickness of its photosensitive layer.

Further, as the photosensitive drum 11 reduces in the thickness of its photosensitive layer, the alternating current is likely to become excessive if the drum charging AC voltage is left unchanged. If the alternating current is allowed to continue to flow by an excessive amount, the photosensitive layer of the photosensitive drum 11 increases in abrasion rate. Therefore, it is desired that the drum charging AC voltage is reduced as the photosensitive drum 11 reduces in the thickness of its photosensitive layer. This is also true with the primary transfer voltage. That is, it is desired that the primary transfer voltage also is reduced as the photosensitive drum 11 reduces in the thickness of its photosensitive layer.

In the case of the second comparative operation for estimating the thickness of the photosensitive layer of the photosensitive drum 11, the thickness of the photosensitive layer of the photosensitive drum 11 is simply estimated from the detected amount of the DC voltage. This method ignores the ambient temperature and humidity of the image forming apparatus 100, fluctuation in the electrical resistance of the charge roller 12, etc. That is, it does not take into consideration, the ambient temperature and humidity of the image forming apparatus 100 and the instability of the charge roller 12 in the amount of its electrical resistance, when estimating the thickness of the photosensitive layer of the photosensitive drum. Therefore, if the ambient temperature and humidity of the image forming apparatus 100 are substantially different from those measured previously, and/or drum cartridges are different in the electrical resistance of the charge roller 12, the direct current is likely to fluctuate in amount while it is measured. Therefore, the thickness of the photosensitive layer of the photosensitive drum 11 is likely to be erroneously detected.

<Second Comparative Operation for Estimating Thickness of Photosensitive Layer of Photosensitive Drum>

Figure 9:
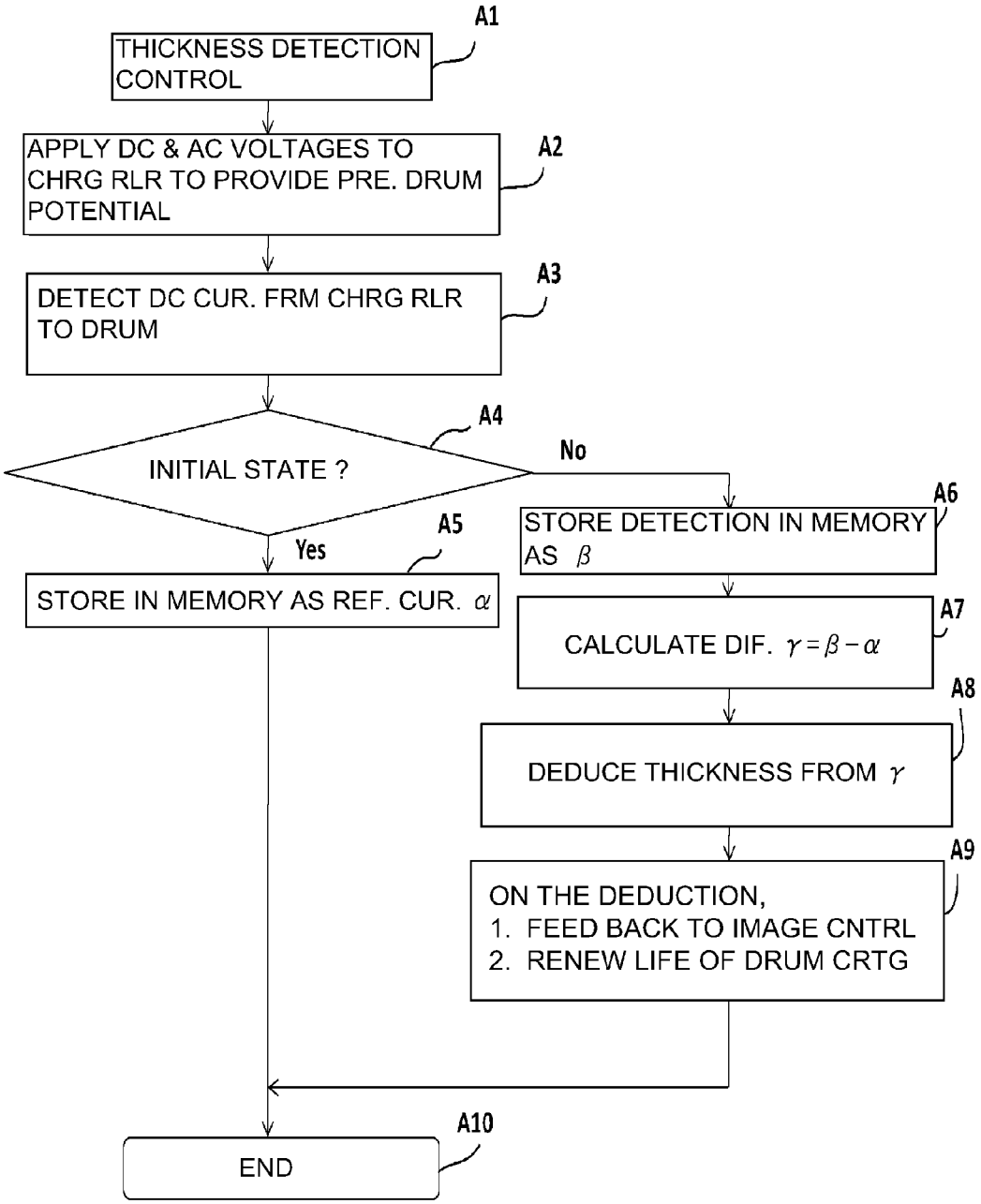
FIG. 9 is a flowchart of the second comparative operation for estimating the thickness of the photosensitive layer.
Figure 10:
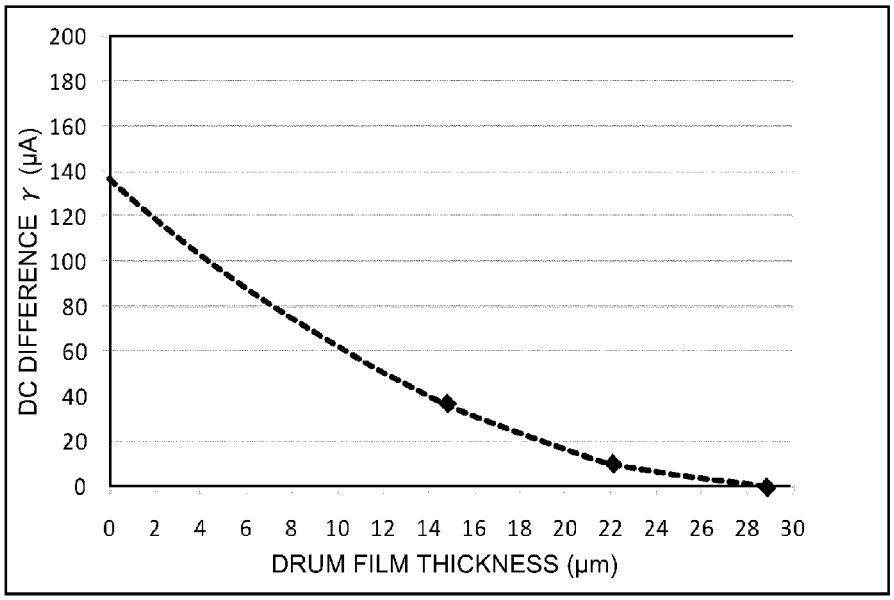
FIG. 10 is a graph which shows the relationship between the differential current amount and the actually measured thickness of the photosensitive layer.
Figure 11:
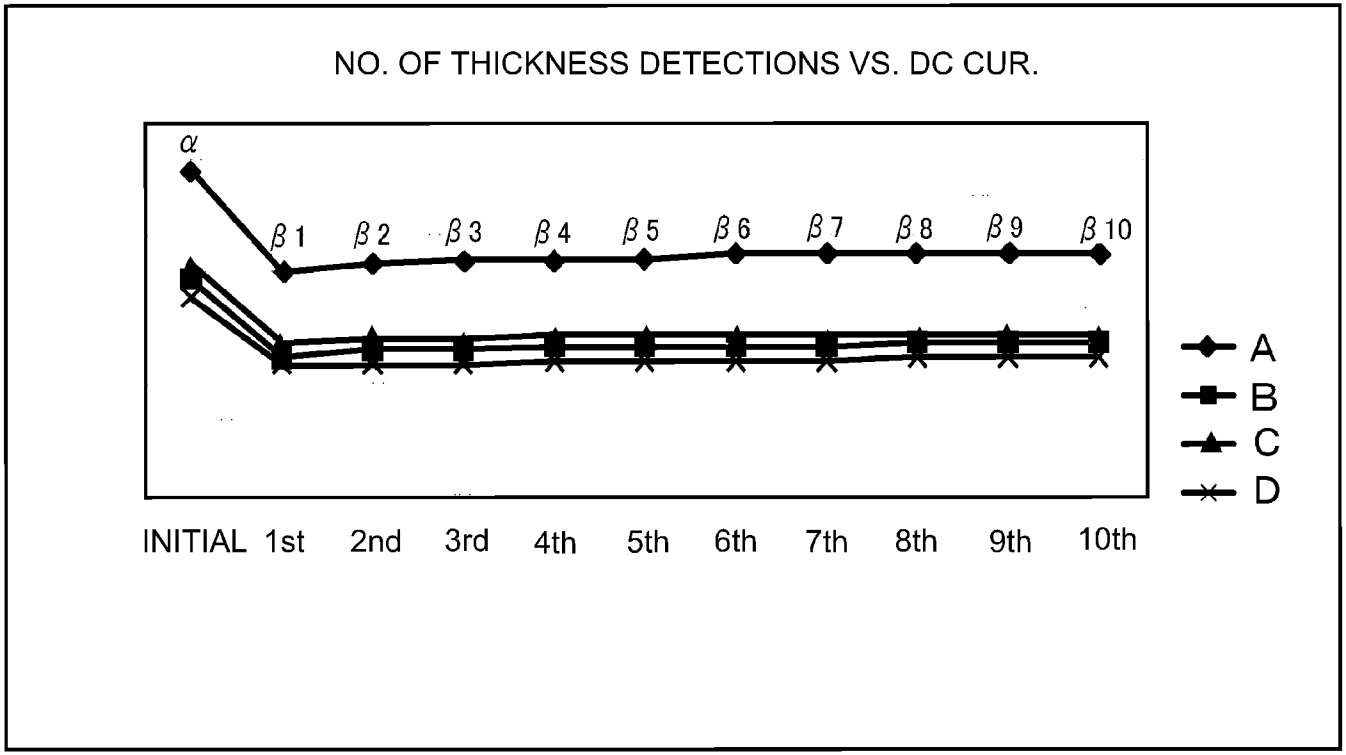
FIG. 11 is a graph which shows the amounts of DC voltage measured each time the operation for estimating the thickness of the photosensitive layer of the photosensitive drum 11 is carried out.

FIG. 9 is a flowchart of the second comparative operation for estimating the thickness of the photosensitive layer of the photosensitive drum 11. FIG. 10 is a graph which shows the relationship between the difference in the amount of the differential current and the measured amount of the thickness of the photosensitive drum 11. FIG. 11 is a graph which shows the amounts of DC voltage measured each time the operation for estimating the thickness of the photosensitive layer of the photosensitive drum 11 is carried out.

In order to more accurately track the changes in the thickness of the photosensitive layer of the photosensitive drum 11 than the first comparative operation for estimating the thickness of the photosensitive layer of the photosensitive drum 11, the second comparative operation for estimating the thickness of the photosensitive layer of the photosensitive drum 11 continuously evaluates the relative changes of the direct current amount, starting from when the photosensitive drum is in the initial state (brand-new). In order to estimate the thickness of the photosensitive layer of the photosensitive drum 11 at a higher level of accuracy, the second comparative operation for estimating the thickness of the photosensitive layer of the photosensitive drum 11 estimates the thickness of the photosensitive layer of the photosensitive drum 11, based on the differential current amount $\gamma$, that is, the amount of difference between the referential amount $\alpha$ of direct current measured when the drum cartridge is brand-new and an amount $\beta$ of the direct current measured during the subsequent operation for estimating the thickness of the photosensitive layer of the photosensitive drum 11.

The side wall of a drum cartridge is provided with a fuse for determining whether the cartridge is brand-new or used one. Further, the image forming apparatus 100 is designed so that as the main switch of the image forming apparatus 100 is turned on after the installation of the drum cartridge into the main assembly of the image forming apparatus 100, electrical current is flowed through the fuse to blow the fuse in several seconds. As the control section 201 receives the signal which indicates that the fuse has just been blown, it recognizes that the drum cartridge is brand-new.

The method for determining whether or not a drum cartridge is brand-new does not need to be limited to the above described one. For example, the image forming apparatus 100 and drum cartridge therefor may be set up so that as a user or a service person presses a "switch for starting the operation for initializing the drum cartridge", the control section 201 recognizes that the drum cartridge is brand-new.

Referring to FIG. 9 along with FIG. 4, as a command for starting the operation for estimating the thickness of the photosensitive layer of the photosensitive drum 11 is issued (A1), the control section 201 sets the drum charging DC voltage and drum charging AC voltage so that the photosensitive drum 11 is charged to a preset potential level (A2). In order to ensure that the thickness of the photosensitive layer of the photosensitive drum 11 is accurately reflected by the amount of the direct current, the initial operation for estimating the thickness of the photosensitive layer of the photosensitive drum 11 for obtaining the referential amount $\alpha$ for the direct current, and the second operation, and thereafter, for detecting the amount $\beta$ of the direct current to estimate the thickness of the photosensitive layer of the photosensitive drum 11, are kept the same in the potential level of the photosensitive drum 11.

The control section 201 detects the amount of direct current which flows into the photosensitive drum 11 from the charge roller 12, with the use of the direct current measurement circuit 104 (A3). After the detection of the amount of the direct current, the control section 201 determines whether the drum cartridge is brand-new or has been in use in the image forming apparatus 100 (A4).

If the fuse has not been blown (Yes in A4), the control section 201 determines that the drum cartridge is brand-new, and performs the first (initial) operation for estimating the thickness of the photosensitive layer of the photosensitive drum 11, in which it measures the amount of the direct current, stores the measured amount of the direct current as the amount $\alpha$ in the memory 202 (A5), and ends the first (initial) operation for estimating the thickness of the photosensitive layer of the photosensitive drum 11 (A10). The control section 201 determines, as necessary, whether or not the photosensitive drum 11 is brand-new. If it determines the drum cartridge in the image forming apparatus 100 is brand-new, it resets the image forming apparatus 100 in image formation settings, and also, resets the information about the length of the residual life of the drum cartridge, etc., to show the cartridge is brand-new.

If the control section 201 detects that the fuse has been blown, and therefore, cannot detect the signal that indicates that the fuse has just been blown (No in A4), it determines that the drum cartridge in the image forming apparatus 100 is the one which has been in use in the image forming apparatus 100, and carries out the second operation for estimating the thickness of the photosensitive layer of the photosensitive drum 11, or the one thereafter. Then, it stores the detected amount of the direct current as the amount $\beta$ in the memory 202 (A6). Then, the control section 201 calculates the differential current amount $\gamma$, that is, the amount of difference between the initial referential amount $\alpha$ of the direct current stored in the memory 202 when the drum cartridge was brand-new, and the detected amount $\beta$ of the direct current (A7). That is, during each of the second operation, and the operations thereafter, for estimating the thickness of the photosensitive layer of the photosensitive drum 11, the control section 201 calculates the differential current amount $\gamma$ detected in each of the second operation for estimating the thickness of the photosensitive layer of the photosensitive drum 11 and thereafter.

The correlation, shown in FIG. 10, between the differential current amount $\gamma$ and the thickness of the photosensitive layer of the photosensitive drum 11 is obtained in advance and is held in the control section 201. Thus, the control section 201 estimates the thickness of the photosensitive layer of the photosensitive drum 11, based on the differential current amount $\gamma$ between the amount $\beta$ of the direct current detected by the second operation, and thereafter, for estimating the thickness of the photosensitive layer of the photosensitive drum 11, and the referential amount $\alpha$ of the direct current, with reference to the conversion table in FIG. 10. Then, the control section 201 estimates the thickness of the photosensitive layer of the photosensitive drum 11 of the drum cartridge from the relationship between the calculated amount of differential current amount $\gamma$ and the thickness of the photosensitive layer of the photosensitive drum 11 (A8).

Then, the control section 201 changes the settings for the exposing device 13, DC power source 101, AC power source 102, power source of the developing device 14, and power source of the primary transfer roller, etc., by feeding back the estimated thickness of the photosensitive layer of the photosensitive drum 11 to the image formation settings. Further, regarding the length of the residual life of the cartridge, the control section 201 adjusts the length of the residual life of the drum cartridge based on the thickness of the photosensitive layer of the photosensitive drum 11 calculated from the differential current amount $\gamma$, and displays the adjusted length of the residual life of the drum cartridge (A9). Then, the control section 201 ends the operation for estimating the thickness of the photosensitive layer of the photosensitive drum 11 which is to be carried out when the drum cartridge is not brand-new (S10).

In the case of the second comparative operation for estimating the thickness of the photosensitive layer of the photosensitive drum 11, it uses the amount of the direct current which flows from the charge roller 12 into the photosensitive drum 11 when the drum cartridge is brand-new, as the referential amount $\alpha$ for the direct current, and estimates the thickness of the photosensitive layer of the photosensitive drum 11 based on the differential current amount $\gamma$ between the amount $\beta$ of the direct current detected in each of the second operation, and thereafter, for estimating the thickness of the photosensitive layer of the photosensitive drum 11, and the referential amount $\alpha$. Further, it detects the amount (as referential amount $\alpha$) of the direct current which flows from a brand-new charge roller to the photosensitive drum 1, and estimates the amount of the changes in the thickness of the photosensitive layer of the photosensitive drum 11 from the differential current amount $\gamma$ between the measured amount $\beta$ of the direct current and the referential amount $\alpha$. Therefore, the second comparative operation for estimating the thickness of the photosensitive layer of the photosensitive drum 11 can suppress (eliminate) the effects of the ambient temperature and humidity of the image forming apparatus 100, and fluctuation in the electrical resistance of the charge roller 12, etc., which are the causes of the erroneous detection of the amount of the direct current, by the first comparative operation for estimating the thickness of the photosensitive layer of the photosensitive drum 11.

By the way, in recent years, not only has it come to be desired that the drum cartridge is extended in the length of the life of its photosensitive drum 11, but also, in the length of the life of other parts than the photosensitive drum. Thus, a charge roller, the elastic layer of which is formed of such rubber that is made electrically conductive by the dispersion of ionic conductor in the rubber, has come to be widely employed. In a charge roller, the conductive layer of which is based on ionic conductor, ions actively move in the conductive layer, conveying thereby electric charge. Therefore, it is small in the amount of ion segregation. Thus, it remains small in the amount of changes in electrical resistance, remaining therefore stable in charging performance substantially longer than a charge roller, the conductivity of which comes from the carbon particles dispersed in its conductive layer. However, the experiment in which the thickness of the photosensitive layer of the photosensitive drum 11 was measured with the use of the second comparative operation for estimating the thickness of the photosensitive layer of the photosensitive drum 11 and a charge roller based on ionic conductor proved that the charge roller based on ionic conductor also has a problem.

If the amount of the direct current, which is to be used as the referential amount $\alpha$ for the direct current, is measured before the charge roller 12 becomes stable in the amount of electrical resistance, the referential amount $\alpha$ for the direct current is erroneously set. With the referential amount $\alpha$ being erroneously set, the differential current amount $\gamma$ between the referential amount $\alpha$ and the amount $\beta$ of the direct current measured thereafter will also be wrong. Consequently, the control section 201 fails to correctly estimate the changes in the thickness of the photosensitive layer of the photosensitive drum 11. Therefore, various problems occur. For example, the control section 201 will err in image density setting, voltage settings, etc., which are to be adjusted in response to the changes in the thickness of the photosensitive layer of the photosensitive drum 11. Further, the length of the residual life of the drum cartridge will be erroneously estimated.

Next, referring to FIG. 11, an experiment was carried out in which the direct current amounts $\beta 1$, $\beta 2$, $\beta 3$ . . . sequentially taken up through the first, second, third, . . . operation for estimating the thickness of the photosensitive layer of the photosensitive drums, carried out after the initial detection of the amount of the direct current, were compared with the referential value $\alpha$, which is the value of the amount of the direct current detected when the charge roller 12 is brand-new. The experiment showed that the direct current amount $\beta 1$ is substantially smaller than the referential value $\alpha$, that is, the amount of the direct current measured when the charge roller 12 was brand-new; the amount of the direct current substantially reduces right after the brand-new charge roller 12 is put to use. After the amount of the direct current reduced to the amount $\beta 1$, it is gradually increased to the amounts $\beta 2$, $\beta 3$, $\beta 4$, . . . , each time the direct current was measured thereafter. That is, the amount $\beta 1$ of the direct current, which should be larger than the referential amount $\alpha$ because the direct current is expected to gradually increases as the photosensitive layer of the photosensitive drum 11 is gradually abraded, was smaller than the referential amount $\alpha$.

In the case of the second comparative operation for estimating the thickness of the photosensitive layer of the photosensitive drum 11, the referential amount $\alpha$ was obtained assuming that the amount of the electrical resistance of the charge roller 12 is the same as that when the charge roller 12 is brand-new. Therefore, if the charge roller 12 changes in the amount of its electrical resistance after the initial measurement of the amount of the direct current, the thickness of the photosensitive layer of the photosensitive drum 11 is erroneously detected, and the greater the change in the amount of the electrical resistance of the charge roller 12, the greater the error. With the estimation of the thickness of the photosensitive layer of the photosensitive drum 11 being substantial in error, the feedback of the estimated thickness of the photosensitive layer of the photosensitive drum 11 to the image formation settings will be wrong one, which results in the display of wrong information about the length of the residual life of the drum cartridge.

However, it became evident that once the direct current amount $\beta n$ detected in the n-th operation for estimating the thickness of the photosensitive layer of the photosensitive drum 11 became greater than the direct current amount $\beta n-1$ detected in the $(n-1)$-th operation for estimating the thickness of the photosensitive layer of the photosensitive drum 11, the direct current amount $\beta$ never become smaller than the direct current amount $\beta n-1$, as FIG. 11 shows.

Therefore, it was proposed to stabilize the charge roller 12 in electrical resistance value by flowing electric current through the charge roller 12 before placing the charge roller 12 in the drum cartridge. However, aging the charge roller 12 during the mass-production of the charge roller 22 requires additional consumption of electrical power, which is against energy conservation, and also, increases the charge roller 12 in manufacturing cost. Further, aging of the charge roller 12 requires a substantial length of time, reducing in efficiency the mass-production of the charge roller 12.

Further, continuously applying oscillating voltage to the charge roller 12 for hours while idling the photosensitive drum 11, in order to stabilize the charge roller 12 in the amount of its electrical resistance, makes a user wait for hours, and therefore, is not realistic. It is also not realistic to continuously idle the photosensitive drum 11 while continuously applying oscillating voltage to the charge roller 12 for hours, because each charge roller 12 is different from the other in the length of time it takes for it be to stabilize in the amount of its electrical resistance by the continuous flow of electric current through the charge roller 12; the length of time it takes to stabilize the charge roller 12 falls in a range of 1-6 hours.

In the following embodiments of the present invention, therefore, during a preset length of time after the starting of the usage of the drum cartridge (after installation of photosensitive member into image forming apparatus), the referential amount $\alpha$ for the direct current is adjusted with preset intervals until the differential current amount $\gamma$ becomes precisely correspondent to the thickness of the photosensitive layer of the photosensitive drum 11. More concretely, the direct current amount $\beta n$ detected by the operation for estimating the thickness of the photosensitive layer of the photosensitive drum 11 carried out after the initial operation for estimating the thickness of the photosensitive layer of the photosensitive drum 11 is compared with the referential amount $\alpha 0$ detected by the operation for estimating the thickness of the photosensitive layer of the photosensitive drum 11 carried out when the charge roller 12 is brand-new. If the direct current amount $\beta n$ is smaller than the referential direct current amount $\alpha 0$, the referential direct current amount $\alpha$ is changed from the differential current amount $\alpha 0$ to the direct current amount $\beta n$, that is, the referential direct current amount $\alpha$ is renewed (changed) to the referential direct current amount $\alpha n$, which is equal to the current amount $\beta n$.

Embodiment 1

Figure 12:
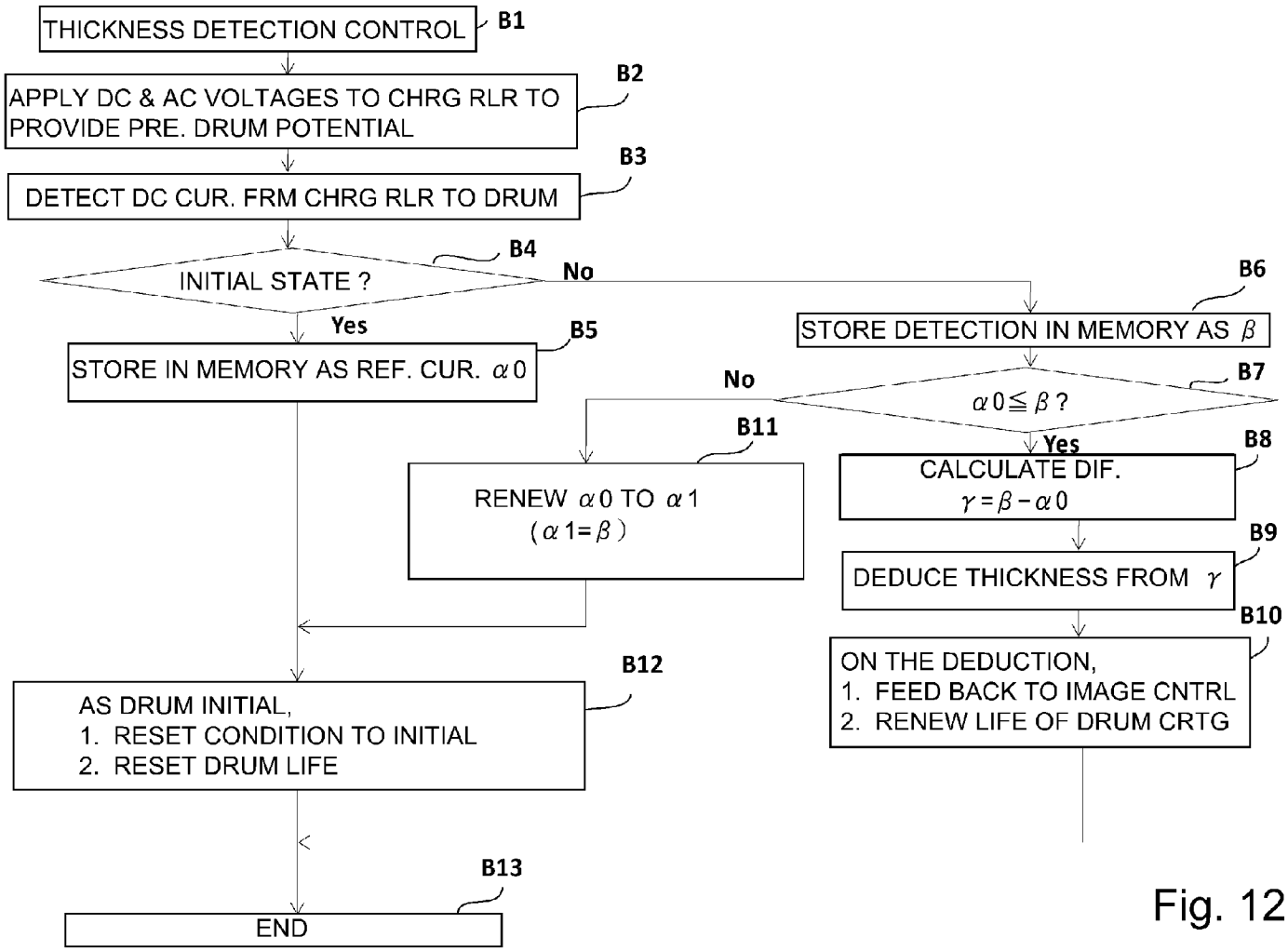
FIG. 12 is a flowchart of the operation, in the first embodiment of the present invention, for estimating the thickness of the photosensitive layer of the photosensitive member.

FIG. 12 is a flowchart of the operation for estimating the thickness of the photosensitive layer of the photosensitive drum 11, in the first embodiment of the present invention. Referring to FIG. 4, the photosensitive drum 11 which is an example of a photosensitive member, and the charge roller 12, as a rotational charging member, which is an example of a charging member, are assembled as the integral parts of the drum cartridge so that they can be replaced together. The charge roller 12 is placed in contact with, or in the adjacencies of, the peripheral surface of the photosensitive drum 11 to give electrical charge to the peripheral surface of the photosensitive drum 11 or receive electric charge from the peripheral surface of the photosensitive drum 11. The charge roller 12 is a roller that has an elastic layer which contains ionic conductor.

The pre-exposure device 16 which is an example of a charge removing means rids the peripheral surface of the photosensitive drum 11 of electrical charge to reduce in potential the peripheral surface of the photosensitive drum 11 to a preset level. The power source S1 applies to the charge roller 12 the voltage for charging the photosensitive drum 11. The voltage applied to the charge roller 12 to charge the photosensitive drum 11 is an oscillating voltage which is a combination of DC voltage and AC voltage.

The direct current measurement circuit 104 which is an example of the current detecting section detects the amount of electric current which flows when a preset detection voltage is applied to the charge roller 12 by the power source S1 while the potential of the peripheral surface of the photosensitive drum 11 is kept at a preset level by the pre-exposure device 16 before the photosensitive drum 11 is charged. The control section 201 which functions as a signal outputting section outputs signal for giving a user or a service person the information about the length of the residual life of the photosensitive member, based on the differential current amount $\gamma$ between the amount $\beta$ of the direct current detected by the direct current measurement circuit 104 and the referential current amount $\alpha n$.

In a case where the direct current amount detected after the photosensitive drum 11 began to be used is smaller than the referential direct current amount $\alpha 0$, the control section 201 estimates the amount by which the thickness of the photosensitive layer of the photosensitive drum 11 has reduced, based on the amount of increase in the direct current relative to the smaller direct current amount, and outputs signals for giving a user or a service person the information about the residual length of life of the drum cartridge, based on the estimated amount of decrease in the thickness of the photosensitive layer of the photosensitive drum 11. The control section 201 adjusts the referential direct current amount $\alpha$ based on the output of the direct current measurement circuit 104, so that as the direct current amount ($\beta$) reduces after the photosensitive drum 11 began to be used, the referential direct current amount $\alpha$ reduces. Further, the control section 201 automatically determines when the photosensitive drum 11 began to be used, and stores the initial direct current amount $\alpha 0$ in the memory as a storage section. If the direct current amount $\beta$ detected after the photosensitive drum 11 began to be used is smaller than the referential direct current amount $\alpha 0$, the control section 201 which has a function of renewing the information, renews the referential direct current amount in the memory from the referential direct current amount $\alpha 0$ to the detected direct current amount $\beta$.

The information about the length of the residual life of the photosensitive member may be defined as (1) the thickness of the photosensitive layer, (2) the length of residual life of the photosensitive drum, or the point in time at which the photosensitive drum (drum cartridge) is to be replaced. However, it includes also the other information about the life of the photosensitive drum than the abovementioned ones.

The dissemination of the information about the length of the residual life of the photosensitive member includes displaying the information about the residual length of the life of the photosensitive member on the monitor of the control panel of the image forming apparatus 100, and displaying the information on the monitor of a personal computer, a mobile device, and the like external device, through a communication network which connects the image forming apparatus 100 with the external devices. It includes also the case in which a server, a personal computer, and the like device, are positioned between the image forming apparatus and the terminal. Here, the communication network means not only wired network, but also, wireless network.

Outputting the signals for disseminating information about the residual length of the photosensitive member includes outputting signals from the control section to display the information on the monitor of the control panel of the image forming apparatus 100, and outputting signals for displaying the information on the external terminals of the image forming apparatus 100 through wired or wireless network.

The control section 201 can (3) alter the voltage to be applied to the charge roller 12 to charge the photosensitive drum 11, and also, (4) can alter the voltage to be applied to transfer the toner image on the photosensitive drum 1, in response to the thinning of the photosensitive layer of the photosensitive drum 11, which is detected based on the differential current amount $\gamma$ between the direct current amount ($\beta$) detected by the direct current measurement circuit 104 and the referential direct current amount $\alpha n$.

Referring to FIG. 12 along with FIG. 4, as the control section 201 detects the arrival of the timing with which the thickness of the photosensitive layer of the photosensitive drum 11 is to be detected, it begins to estimate the thickness of the photosensitive layer (B1). As described above, the timing with which the control section 201 estimates the thickness of the photosensitive layer is right after the image forming apparatus 100 is started up, and every 1,000th image formed thereafter. The control section 201 applies a preset oscillating voltage to the charge roller 12 (B2), and detects the direct current amount $\beta$ with the use of the direct current measurement circuit 104 (B3) as in the case of the second comparative.

If the fuse has not been blown, the control section 201 determines that the drum cartridge is brand-new, whereas if the fuse has been blown, the control section 201 determines that the drum cartridge has been in use in the image forming apparatus 100 (B4).

If the drum cartridge is brand-new (Yes in B4), the control section 201 stores the detected direct current amount $\beta$ in the memory 202 as the referential direct current amount $\alpha 0$ (B5). Then, it adjusts the image forming apparatus in the image formation settings, and renews the information about the residual length of the life of the drum cartridge in the memory 202 (B12).

If the drum cartridge has been in use in the image forming apparatus 100 (No in B4), the control section 201 takes in the detected direct current amount $\beta$ (B6), reads out the referential direct current amount $\alpha 0$ in the memory 202, and compare the direct current amount $\beta$ with the referential direct current amount $\alpha 0$ (B7). If the direct current amount $\beta$ is no more than the referential direct current amount $\alpha 0$ (No in B7), the control section 201 replaces the referential direct current amount $\alpha 0$ in the memory 202 with the direct current amount $\beta$ as the referential direct current amount $\alpha 1$ (B11). As long as the detected direct current amount $\beta$ is no more than the referential direct current amount $\alpha$, the control section 201 continues to replace the referential direct current amount $\alpha$ in the memory 202 with the detected direct current amount β (αn=βn). If the detected direct current amount β is no less than the referential direct current amount αn in the memory 202 (αn>β) (No in B7), the control section 201 replaces the referential direct current amount αn with the direct current amount β as the referential direct current an (B11). That is, if the detected direct current β is no more than the referential direct current amount αn, the control section 201 replaces the referential direct current amount αn in the memory 202 with the detected direct current amount β as the new referential direct current amount αn (αn=β). In other words, as long as the detected direct current amount β is no more than the referential direct current amount α in the memory 202, the control section 201 continues to replace the referential direct current amount α in the memory 202 with the detected direct current amount β.

Each time the control section 201 replaces the referential direct current amount α with the detected direct current amount β, it treats the drum cartridge as if the drum cartridge is brand-new, resets the image forming apparatus 100 in image formation settings, and renews the information about the residual length of the life of the drum cartridge, in the memory 202 (B12). Then, the control section 201 ends the operation for estimating the thickness of the photosensitive layer of the photosensitive drum 11, which is to be carried out when the drum cartridge is not brand-new (B13).

If the direct current amount β is no less than the referential direct current amount α0 (Yes in B7), the control section 201 calculates the differential current amount γ between the direct current amount β and the referential direct current amount α (B8). Then, the control section 201 estimates the thickness of the photosensitive layer of the photosensitive drum 11 from the differential current amount γ, with reference to the conversion table in FIG. 10 (B9). Then, the control section 201 adjusts the image forming apparatus 100 in various image formation settings, and renews the information about the residual length of the life of the drum cartridge, stored in the memory 202 (B10). Then, it ends the operation for estimating the thickness of the photosensitive layer of the photosensitive drum 11 (B13), as in the case of the above-described second comparative operation.

In the first embodiment of the present invention, the control section 201 estimates the thickness of the photosensitive layer of the photosensitive drum 11 based on the relationship between the differential current amount γ between the real time direct current amount β and referential direct current amount α, and the thickness of the photosensitive layer. Further, while estimating the thickness of the photosensitive layer of the photosensitive drum 11, the control section 201 continues to renew the referential direct current amount α in the memory 202 with the fresh (newest and more accurate) referential direct current amount, which the control section 201 obtained while it is estimating the thickness of the photosensitive layer of the photosensitive drum 11. Thus, the first embodiment can enable the control section 201 to more accurately estimate the thickness of the photosensitive layer of the photosensitive drum 11, enabling therefore the control section 201 to more accurately control (adjust) the image forming apparatus 100 in image formation settings in response to the changes in the thickness of the photosensitive layer of the photosensitive drum 11, and give a user or a service person more accurate information about the length of the residual life of the drum cartridge than any operation, in accordance with the prior art, for estimating the thickness of the photosensitive layer.

The first embodiment makes it possible to very accurately estimate the change in the thickness of the photosensitive layer of the photosensitive drum 11 in the drum cartridge which contains an ionic conductor roller which has not been stabilized in the activity of the ionic conductor. Thus, it makes it possible to enable an image forming apparatus having an ionic conductor charge roller which is necessary to prolong the drum cartridge life, to precisely estimate the change in the thickness of the photosensitive layer of the photosensitive member, with the use of a very inexpensive method. Thus, the first embodiment can make an electrophotographic image forming apparatus more reliable in image control, more stable in image quality, more accurate in the estimation of the length of the residual life of the drum cartridge, and more accurate in the level of accuracy at which the residual length of the life of the drum cartridge, than any electrophotographic image forming apparatus in accordance with the prior art.

In a case where the charge roller 12 continues to reduce in the amount of electrical resistance for a long time after it began to be used, it is desired that the length of time the charge roller 12 continues to reduce in the amount of electrical resistance is also counted as a part of the cumulative length of usage of a drum cartridge. The control section 201, as an information obtaining means, obtains the cumulative number of images formed during the period from when the photosensitive drum 11 begins to be used to when the final referential direct current amount is set, and controls the image forming apparatus 100, based on the sum of the cumulative amount of charge given to the photosensitive drum 11 before the final referential direct current amount is set, and the cumulative amount of charge given to the photosensitive drum 11 which corresponds to the differential current amount γ between the detected direct current amount and referential direct current amount.

Embodiment 2

Figure 13:
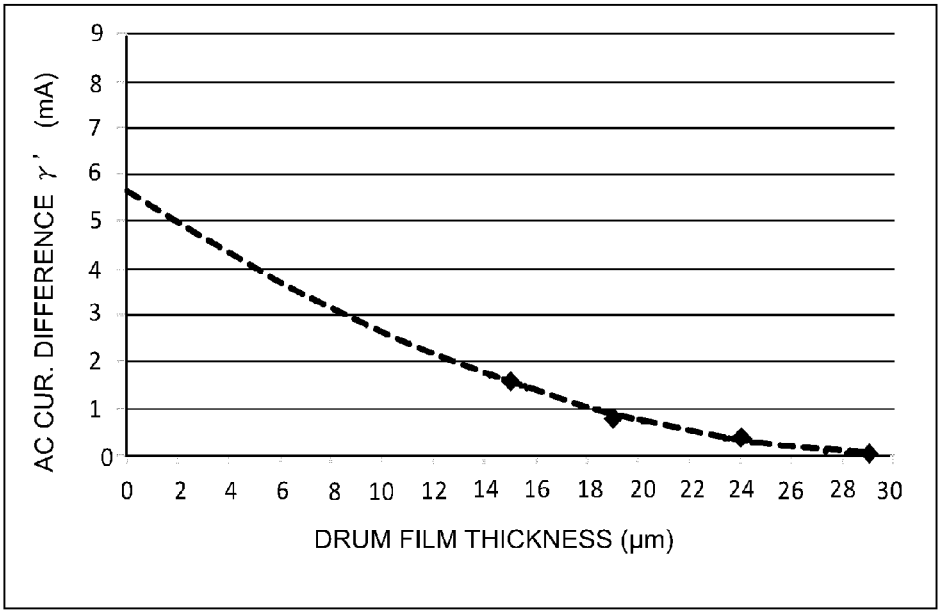
FIG. 13 is a graph which shows the relationship between the amount of the direct current flowed by the AC voltage component of the oscillatory voltage applied to the charge roller, and the actually measured thickness of the photosensitive layer of the photosensitive, in the first embodiment.
Figure 14:
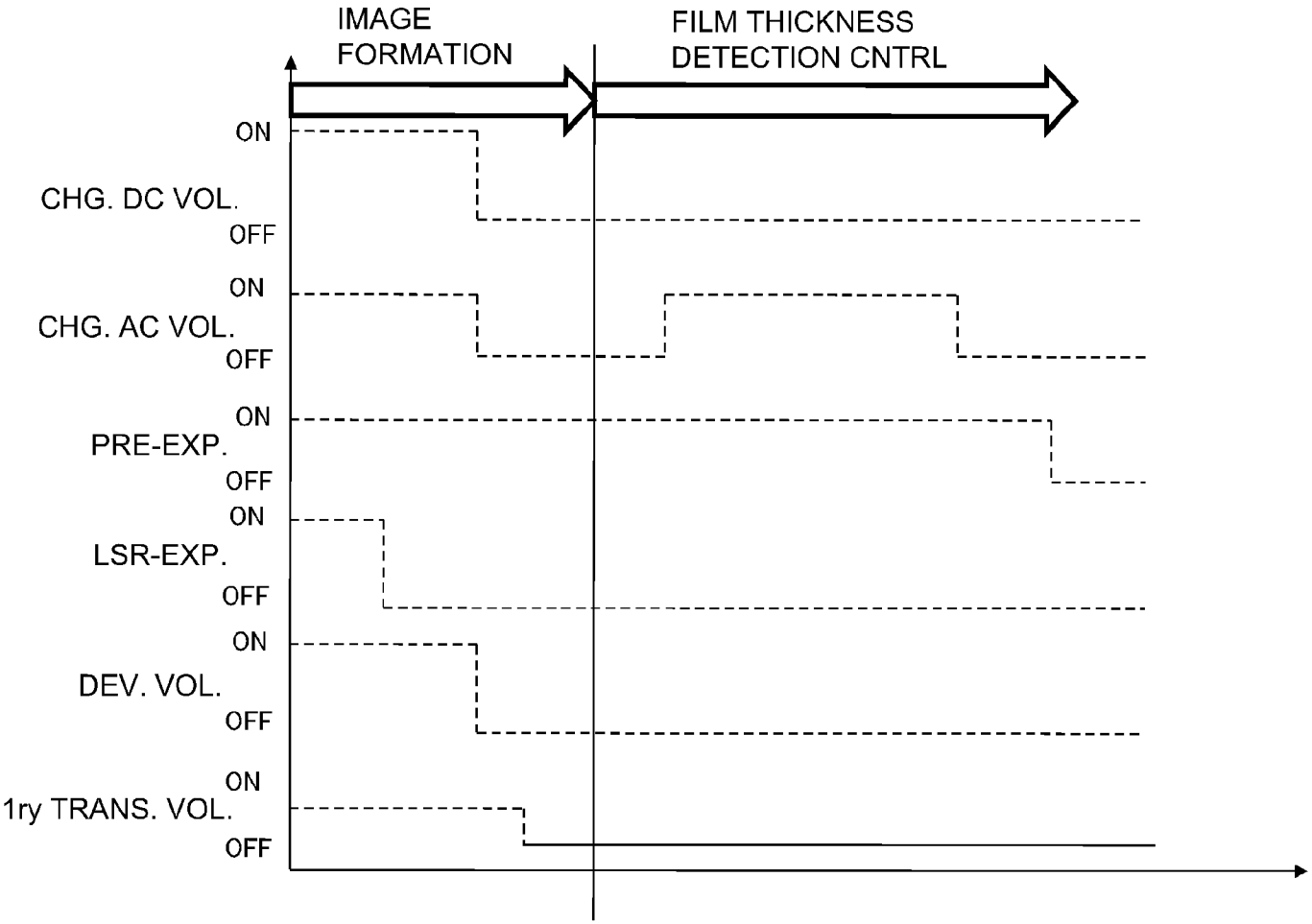
FIG. 14 is a timing chart, in the second embodiment, for the voltage control timing for the operation for estimating the thickness of the photosensitive layer.
Figure 15:
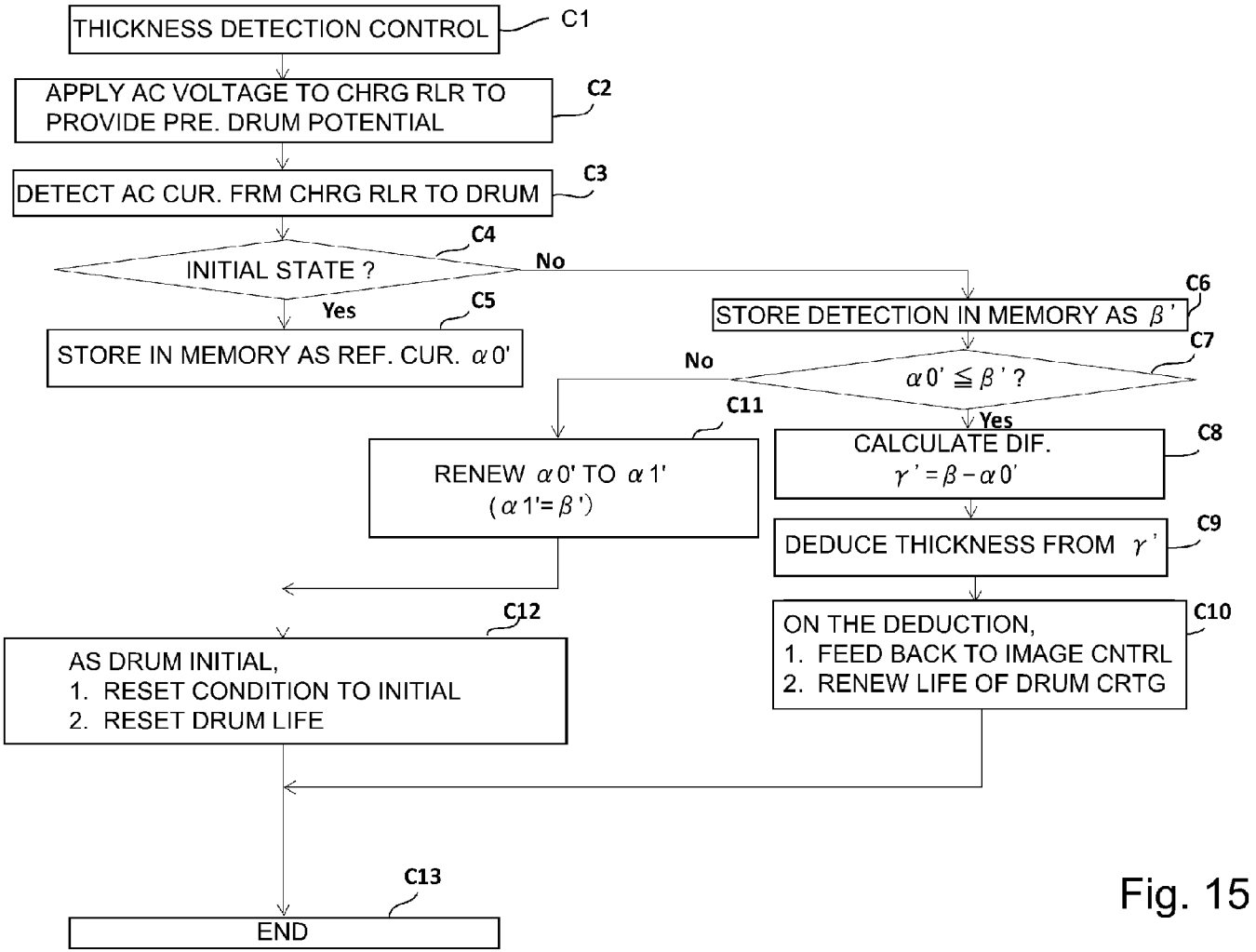
FIG. 15 is a flowchart for the operation, in the second embodiment, for estimating the thickness of the photosensitive layer.

FIG. 13 is a graph which shows the relationship between the amount of alternating current flowed by the oscillating voltage applied to the charge roller 12, and the actual measured thickness of the photosensitive layer of the photosensitive drum 11. FIG. 14 is a timing chart for the operation, in the second embodiment, for estimating the thickness of the photosensitive layer of the photosensitive drum 11. FIG. 15 is a flowchart of the operation, in the second embodiment, for estimating the thickness of the photosensitive layer of the photosensitive drum 11.

In the first embodiment, the thickness of the photosensitive layer of the photosensitive drum 11 was estimated by detecting the amount of the direct current which flowed from the charge roller 12 to the photosensitive drum 11. However, the amount of the direct current which flows from the charge roller 11 to the photosensitive drum 11 is not the only thing based on which the thickness of the photosensitive layer of the photosensitive drum 11 can be estimated.

In the second embodiment, the amount of the alternating current flowed by the AC voltage applied to the charge roller 12 in combination with the DC voltage is detected, and the thickness of the photosensitive layer of the photosensitive drum 11 was estimated based on the detected amount of the alternating current. It has been known that the amount of the alternating current flowed between the charge roller 12 and photosensitive drum 11 is also affected by the thickness of the photosensitive layer of the photosensitive drum 11. Thus, the changes in the thickness of the photosensitive layer of the photosensitive drum 11 can be estimated by detecting the amount of the alternating current.

Referring to FIG. 13, the amount of the alternating current which flows between the charge roller 12 and the photosensitive drum 11 when the photosensitive drum 11 is charged by the application of oscillating voltage to the charge roller 12 is affected by the changes in the thickness of the photosensitive layer of the photosensitive drum 11.

Referring to FIG. 14 along with FIG. 4, the control section 201 estimates the thickness of the photosensitive layer of the photosensitive drum 11 during the multiple pre-rotation of the photosensitive drum 11, and also, for every 1,000 sheets of recording medium conveyed through the image forming apparatus 100. As the control section 201 starts the operation for estimating the thickness of the photosensitive layer of the photosensitive drum 11, first, it sequentially turns off the drum charging DC voltage, drum charging AC voltage, development voltage, and primary transfer voltage, in the listed order, and then, applies only a preset drum charging AC voltage to the charge roller 12.

The amount of the AC voltage applied to the charge roller 12 during the normal image forming operation is determined according to the conditions set through an operation for controlling the image forming apparatus 100 in image density, and therefore, randomly affected by the ambient temperature and humidity of the image forming apparatus 100, cumulative number of images formed by the image forming apparatus 100, etc. In the operation, in the second embodiment, for estimating the thickness of the photosensitive layer of the photosensitive drum 11, the AC voltage to be applied to the charge roller 12 to detect the amount β' of the alternating current is kept unchanged, in order to ensure that the amount β' of the alternating current, which is affected by the thickness of the photosensitive layer of the photosensitive drum 11, can be repeatedly detected at a preset level of accuracy. The amount β' of the alternating current, which is detected to estimate the thickness of the photosensitive layer of the photosensitive drum 11 is affected very little by the potential level of the photosensitive drum 11. Therefore, the DC voltage does not need to be applied when detecting the amount β' of the alternating current.

In the operation for estimating the thickness of the photosensitive layer of the photosensitive drum 1, the control section 201 keeps higher in output, the pre-exposure device 16 which is used for erasing the residual electrostatic image during the normal image forming operation, in order to make the peripheral surface of the photosensitive drum 11 uniform in potential level after the removal of the electric charge from the photosensitive drum 11, that is, before the photosensitive drum 11 is charged. If the photosensitive drum 11 is unstable in potential level, the amount β' of the alternating current is likely to be detected with a large amount of error. Therefore, it is desired that the photosensitive drum 11 is fully discharged. The pre-exposure device 16 is desired to be high in output (beam intensity); it is desired to be no less than 30 μW in output so that it can fully discharge the photosensitive drum 11.

Referring to FIG. 15 along with FIG. 4, as the control section 201 detects the timing with which the thickness of the photosensitive layer of the photosensitive drum 11 is to be detected, it begins to estimate the thickness of the photosensitive layer (C1). Then, the control section 201 applies a preset oscillating voltage to the charge roller 12 (C2), and detects the alternating current amount β' with the use of the drum charging AC voltage detecting section 211 (C3).

If the drum cartridge is brand-new (Yes in C4), the control section 201 stores the detected alternating current amount β' in the memory 202 as the referential alternating current amount α0' (C5). Then, it adjusts the image forming apparatus 100 in the image formation settings, and renews the information about the length of the residual life of the drum cartridge in the memory 202 (C12).

If the drum cartridge has been in use in the image forming apparatus 100 (No in C4), the control section 201 takes in the detected alternating current amount β' (C6), and compared the detected direct current amount β' with the referential alternating current amount α0' (C7).

If the alternating current amount β' is no more than the referential alternating current amount α0' (No in C7), the control section 201 replaces the referential alternating current amount α0' in the memory 202, with the alternating current amount β' as the referential alternating current amount α1' (C11). As long as the detected alternating current amount β' is no more than the referential alternating current amount α', the control section 201 continues to replace the referential alternating current amount α' in the memory 202 with the detected alternating current amount β' (αn'=βn').

Each time the control section 201 replaces the referential alternating current amount α' with the detected alternating current amount β', it treats the drum cartridge as if the drum cartridge is brand-new, resets the image forming apparatus 100 in image formation settings, and renews the information about the length of the residual life of the drum cartridge, in the memory 202 (C12)

If the alternating current amount β' is no less than the referential alternating current amount α0' (Yes in C7), the control section 201 calculates the differential current amount γ between the alternating current amount β' and the referential alternating current amount α0' (C8). Then, the control section 201 estimates the thickness of the photosensitive layer of the photosensitive drum 11 from the differential current amount γ, with reference to the conversion table in FIG. 13 (C9).

Then, the control section 201 adjusts the image forming apparatus 100 in various image formation settings, and renews the information about the length of the residual life of the drum cartridge, as in the first comparative operation for estimating the thickness of the photosensitive layer of the photosensitive drum 11 (C10). Then, it ends the operation for estimating the thickness of the photosensitive layer of the photosensitive drum 11 (C13).

In the second embodiment of the present invention, the control section 201 estimates the thickness of the photosensitive layer of the photosensitive drum 11, based on the relationship between the differential current amount γ' between the real time alternating current amount β' and referential alternating current amount α', and the thickness of the photosensitive layer. Further, in the operation for estimating the thickness of the photosensitive layer of the photosensitive drum 11, the control section 201 continues to renew the referential alternating current amount α' in the memory 202, with the fresh (newest and more accurate) referential alternating current amount α', which the control section 201 obtained while it is estimating the thickness of the photosensitive layer of the photosensitive drum 11. Thus, the second embodiment can enable the control section 201 to more accurately estimate the thickness of the photosensitive layer of the photosensitive drum 11, enabling therefore the control section 201 to more accurately control (adjust) the image forming apparatus 100 in image formation settings in response to the changes in the thickness of the photosensitive layer of the photosensitive drum 11, and give a user or a service person more accurate information about the length of the residual life of the drum cartridge than any operation, in accordance with the prior art, for estimating the thickness of the photosensitive layer.

Embodiment 3

Figure 16:
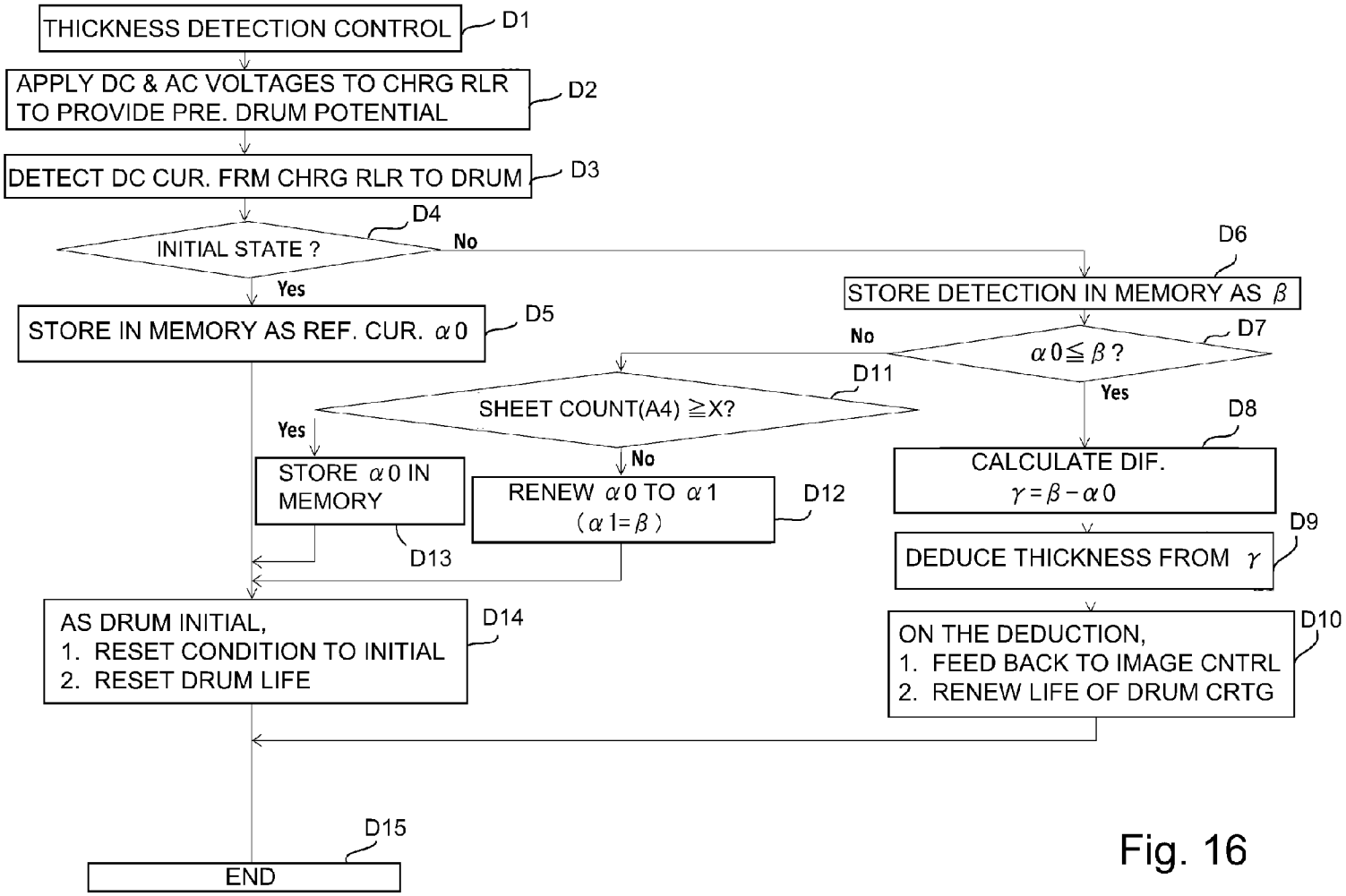
FIG. 16 is a flowchart for the operation, in the third embodiment, for estimating the thickness of the photosensitive layer.

FIG. 16 is a flowchart for the operation, in the third embodiment, for estimating the thickness of the photosensitive layer of the photosensitive drum 11. In the first embodiment, there was no limit to the length of time the referential amount α of the direct current continues to be replaced with a more accurate value, based on the relationship between the amount β of the direct current detected during the operation for estimating the thickness of the photosensitive layer of the photosensitive drum 11, and the referential amount α for the direct current. In comparison, in the third embodiment, the length of time the referential amount α for the direct current continues to be replaced with a more accurate value is limited to the length of time it takes for the cumulative number of images formed from when the drum cartridge was brand-new reaches X.

Referring to FIG. 4, the control section 201 continues to replace the referential amount αn in the memory 202 with the detected amount β of the direct current amount, for every preset number of images formed, until a preset length of time elapses after the photosensitive drum 11 began to be used in the image forming apparatus 100 (when photosensitive drum 11 was installed in image forming apparatus 100).

Referring to FIG. 11, once the direct current amount βn exceeds the referential amount αn for the direct current, the amount β of the direct current, which is detected by the operation for estimating the thickness of the photosensitive layer of the photosensitive drum 11, stabilizes, and will never become smaller than the referential direct current amount αn. However, this theory is based on an assumption that a given image forming job is performed with the use of the same drum cartridge; the drum cartridge in the image forming apparatus 100 is not replaced during the given image forming job. That is, it was assumed that the drum cartridge in the image forming apparatus 100 is not replaced during a given image formation job, and the photosensitive layer of the photosensitive drum 11 in the cartridge gradually reduce in thickness due to abrasion alone.

However, if the drum cartridge in the image forming apparatus 100 is replaced with a used drum cartridge, or the photosensitive drum 11 in the image forming apparatus 100 is replaced with a used photosensitive drum, without replacing the charge roller 12, the photosensitive layer of the photosensitive drum 11 in the replacement drum cartridge, or the photosensitive layer of the replacement photosensitive drum 11, may be thicker than that of the photosensitive drum 11 which was in the image forming apparatus 100. In such a case, a substantial amount of electric current will have flowed through the charge roller 12, and therefore, the ionic conductor of the charge roller 12 will have been stabilized in the amount of electrical resistance. Therefore, even if the photosensitive layer of the replacement photosensitive drum 11 is thicker than that of the replaced photosensitive drum 11, the charge roller 12 does not become a factor which makes the amount βn of the direct current smaller than the referential amount αn (αn>βn). However, the thicker photosensitive layer of the replacement photosensitive drum 11 makes the amount βn of the DC greater than the referential amount αn (αn>βn).

In such a case, it is possible that the direct current amount βn detected after the replacement of the photosensitive drum 11 will be smaller than the referential direct current amount αn (αn>βn), even though the referential direct current amount αn has been properly set. If the direct current amount βn detected after the replacement of the photosensitive drum 11 is smaller than the referential direct current amount αn, the referential direct current amount αn in the memory 202 is replaced with a new referential direct current amount αn+1 (=βn). In the first embodiment, the thickness of the photosensitive layer of the photosensitive drum 11 was estimated based on the phenomenon that as the photosensitive drum 11 reduces in the thickness of its photosensitive layer, it increases in the amount of electrostatic capacity, and therefore, the amount β of the direct current which flows from the charge roller 12 to the photosensitive drum 11 increases. That is, it was not anticipated that the photosensitive layer will suddenly increase in thickness.

The control section 201 determines whether or not a drum cartridge is brand-new, based on whether or not the fuse of the cartridge has been blown. Thus, in a case where a brand-new drum cartridge is installed in the image forming apparatus 100, a new referential amount α0 is set, and therefore, no problem will occur. However, if a service person happens to install a drum cartridge, which has been temporarily used in another image forming apparatus, in the image forming apparatus 100 to find and/or analyze the cause of the formation of unsatisfactory images by the image forming apparatus 100, the fuse of the drum cartridge will have been already blown. Thus, the control section 201 does not determine that the drum cartridge is brand-new. Thus, it replaces the referential direct current amount αn in the memory 202 with a new referential direct current amount αn+1 (=βn), based on the relationship (αn>βn).

Thus, as the drum cartridge, which was in the image forming apparatus 100 before the examination of the image forming apparatus 100 by the service person, is reinstalled in the image forming apparatus 100, the differential current amount γ between the detected direct current amount β and referential direct current amount α has a large amount of error, making it impossible for the control section 201 to accurately estimate the thickness of the photosensitive layer of the photosensitive drum 11. Even when the drum cartridge which was in the image forming apparatus 100 is not reinstalled back into the image forming apparatus 100, as long as the referential direct current amount αn in the memory 202 has not been replaced with the new referential direct current amount αn+1 (=βn), it is assumed that the differential current amount γ came from the increase in the thickness of the photosensitive layer of the photosensitive drum 11. Therefore, the error in the estimation of the thickness of the photosensitive layer is smaller than the error which would have occurred if the referential direct current amount αn were replaced with the new one.

In the third embodiment, therefore, in order to prevent the occurrence of the problem that as the drum cartridge in the image forming apparatus 100 is replaced with a used one, the referential direct current amount αn in the memory 202 is replaced, the operation for estimating the thickness of the photosensitive layer of the photosensitive drum 11 is regulated by a value obtained by converting the cumulative number of images (prints) formed by the drum cartridge in the image forming apparatus 100 since when the cartridge is brand-new. The cumulative number X in terms of A4 size sheet is desired to be large enough for the charge roller 12 to stabilize in the amount of electrical resistance. Normally, it is no more than 5,000 sheets, preferably roughly 2,000 sheets.

Referring to FIG. 16 along with FIG. 4, as the control section 201 detects the timing with which the thickness of the photosensitive layer of the photosensitive drum 11 is to be detected, it begins to estimate the thickness of the photosensitive layer (D1). Then, the control section 201 applies a preset oscillating voltage to the charge roller 12 (D2), and detects the alternating current amount β (D3). If the drum cartridge is brand-new (Yes in D4), the control section 201 stores the detected alternating current amount β in the memory 202 as the referential direct current amount α0 (D5). Then, it adjusts the image forming apparatus 100 in the image formation settings, and renews the information about the length of the residual life of the drum cartridge in the memory 202 (D14).

If the drum cartridge has been in use in the image forming apparatus 100 (No in D4), the control section 201 takes in the detected alternating current amount β (D6), and compares the detected direct current amount β with the referential alternating current amount α0 (D7).

If the alternating current amount β is no more than the referential alternating current amount α0 (No in D7), the control section 201 obtains the cumulative number of sheets conveyed through the image forming apparatus 100 since when the drum cartridge was brand-new (D11).

If the cumulative number of the sheets of recording medium is no more than X in terms of A4 size sheet (No in D11), the control section 201 replaces the referential current amount α0 in the memory 202 with the detected direct current amount β as the referential current amount α1 (D12). That is, it abandons the previous referential current amount αn, and adopts the direct current amount β detected in the ongoing operation for estimating the thickness of the photosensitive layer of the photosensitive drum 11, as the new referential current amount α0, which will be used thereafter (D12). As the referential current amount α is renewed, the control section 201 assumes that the drum cartridge in the image forming apparatus 100 is brand-new, and resets the image forming apparatus 100 in image formation settings, and also, resets the information about the residual length of the life of the drum cartridge so that the monitor shows that the residual length of the drum is brand-new (D14).

If the cumulative number of sheets conveyed through the image forming apparatus 100 is no less than X (calculated in terms of A4 size sheet), the control section 201 leaves the referential current amount α0 as is. That is, if the cumulative number of the sheets conveyed through the image forming apparatus 100 is no less than X in terms of A4 sheet, the control section 201 stores the referential current amount α0, that is, the referential current amount detected when the drum cartridge was brand-new, in the memory 202 which is an example of a storage device, without modifying the amount α0 (D13). That is, even if the cumulative number is no less than X (D13), the control section 201 assumes that the drum cartridge in the image forming apparatus 100 is brand-new, and resets the image forming apparatus 100 in the image formation settings as if the drum cartridge is brand-new, as it does when the cumulative number is no more than X (D12). Then the control section 201 resets the image forming apparatus 100 in the image formation settings as if the drum cartridge therein is brand-new, and also, resets the information about the residual length of the life of the photosensitive drum 11 as if the photosensitive drum is brand-new (D14). Then, the control section 201 ends the operation for estimating the thickness of the photosensitive layer of the photosensitive drum 11, which is to be carried out when the drum cartridge in the image forming apparatus 100 is not brand-new (D15).

If the direct current amount β is no less than the referential direct current amount α0 (Yes in D7), the control section 201 calculates the differential current amount γ between the direct current amount β and the referential direct current amount α (D8). Then, the control section 201 estimates the thickness of the photosensitive layer of the photosensitive drum 11 from the differential current amount γ, with reference to the conversion table in FIG. 10 (D9), as it did in the first embodiment. Then, the control section 201 adjusts the image forming apparatus 100 in various image formation settings, and renews the information about the residual length of the life of the drum cartridge (D10). Then, it ends the operation for estimating the thickness of the photosensitive layer of the photosensitive drum 11 (D15).

In the third embodiment, whether or not the referential current amount α0 is to be renewed is determined based on the cumulative amount of usage of the drum cartridge. More specifically, the cumulative number of recording sheets conveyed through the image forming apparatus 100 since when the drum cartridge was brand-new is converted into the cumulative number of recording sheets in terms of A4 size sheet, and whether or not the referential current amount α0 is to be renewed is determined based on whether or not the cumulative number of the recording sheets conveyed through the image forming apparatus 100 is no less than X or not (D11). If the converted cumulative number of the recoding sheets is no less than X, the referential current amount α0 is not replaced with the detected direct current amount β (amount β does not replace amount α0 as amount α1), even if α0>β; the referential current amount α0 is left untouched in the memory 202 (D13).

On the other hand, if the converted cumulative number is no more than X, and α0>β, the control section 201 determines that the referential current amount α0 set when the drum cartridge was brand-new is wrong, and puts the referential current amount α0 back in the memory 202 as the referential direct current amount α1 (=β) (D12).

Also in the operation in the third embodiment of the present invention, the referential current amount α0, which is set when the drum cartridge in the image forming apparatus 100 is brand-new, continues to be replaced with the new referential current amount αn, based on the result of the operation which is carried out with preset intervals to estimate the thickness of the photosensitive layer of the photosensitive drum 11. Therefore, the thickness of the photosensitive layer is accurately estimated. In addition, the operation is regulated by the cumulative number of the recording sheets conveyed through the image forming apparatus 100. Therefore, the operation in this embodiment eliminates the problem that occurs if the drum cartridge in the image forming apparatus 100 is replaced with such a drum cartridge that was used in another image forming apparatus.

Further, in the third embodiment, the operation for estimating the thickness of the photosensitive layer of the photosensitive drum 11 is regulated based on the cumulative number (X) of the recording sheets (calculated in terms of A4 size sheet) conveyed through the image forming apparatus 100. However, the factor to be used for estimating the cumulative length of usage of the photosensitive drum 11 may be the cumulative distance (X') the photosensitive drum 11 has been rotated. The relationship between the cumulative number (X) of the recording sheets conveyed through the image forming apparatus 100 and the error in the estimated thickness of the photosensitive layer of the photosensitive drum 11, and the relationship between the cumulative "distance (X')", the photosensitive drum 11 is rotated, and the error in the estimated thickness of the photosensitive layer, as shown in the following table.

TABLE 1

| Cumulative number (X) of the recording sheets (calculated in terms of A4 size sheet) from initial state of the drum cartridge | Cumulative distance (X') of the photosensitive drum from initial state of the drum cartridge | Occurrence of error in film thickness detection of the photosensitive drum |
|---|---|---|
| 20000 | — | No |
| 30000 | — | No |
| — | 3500 | No |
| — | 5300 | No |

Embodiment 4

Figure 17:
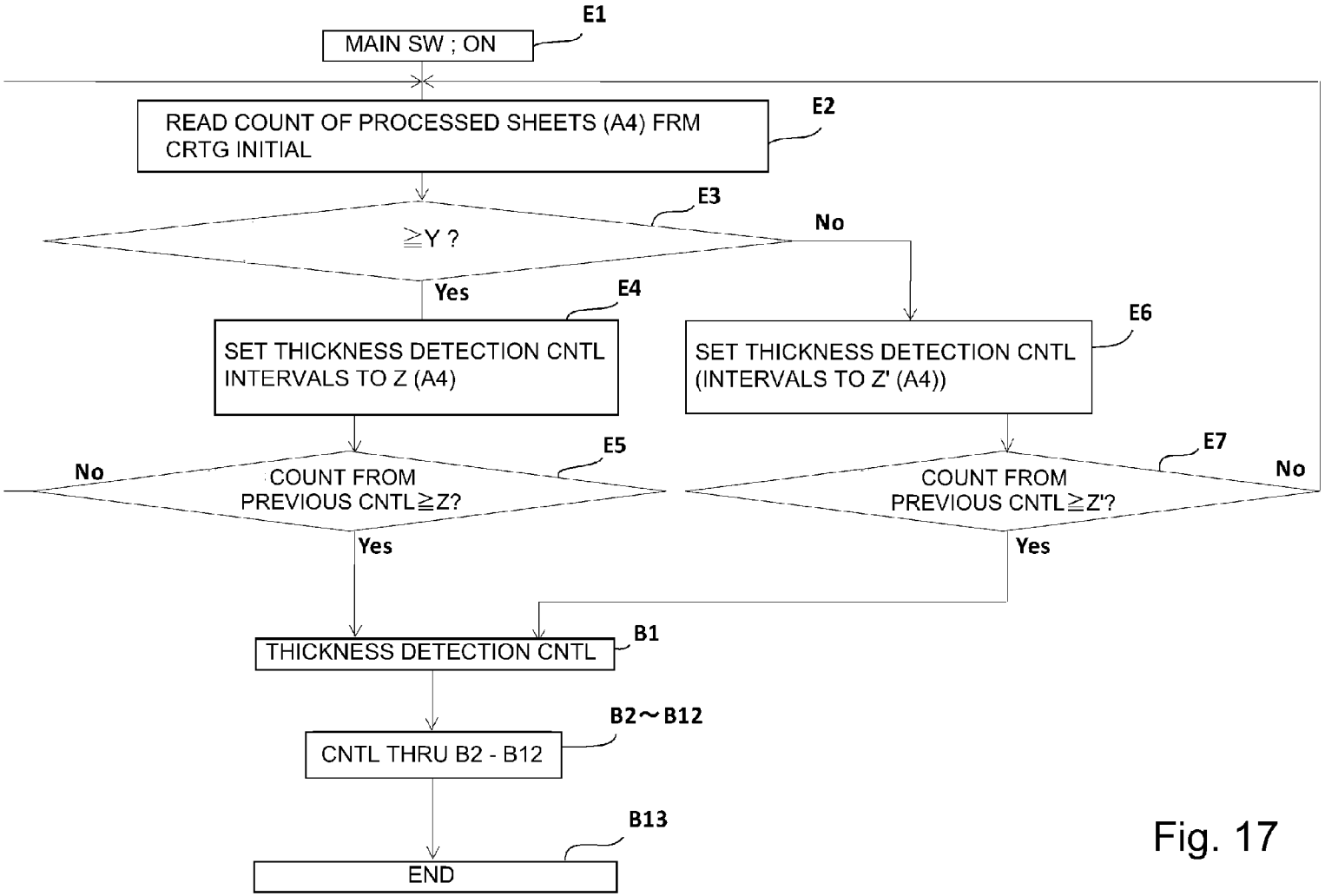
FIG. 17 is a flowchart for the operation, in the fourth embodiment, for estimating the thickness of the photosensitive layer.

FIG. 17 is a flowchart for the operation, in the fourth embodiment, for estimating the thickness of the photosensitive layer of the photosensitive drum 11. In the first embodiment, the operation for estimating the thickness of the photosensitive layer of the photosensitive drum 11 was carried out for every 1,000 sheets of recording medium (in terms of A4 size sheet), from when the drum cartridge is brand-new to the end of the life of the cartridge. In comparison, in the fourth embodiment, the operation is carried out with a higher frequency, for every Z' sheets of recording sheets, until the Y-th recording sheet, at which the charge roller 12 finally stabilizes in the amount of electrical resistance, is conveyed. After the Y-th sheet, the operation is carried out with a lower frequency Z. More concretely, the control section 201 predicts the length of time it takes for the relationship between the detected direct current amount β and referential current amount α to become: α>β, from the cumulative number of the recording sheets conveyed through the image forming apparatus 100. Then, during the period in which it is possible for the relationship between the detected direct current amount β and referential current amount α becomes: α>β, the control section 201 carries out the operation with higher frequency, whereas during the period in which the relationship will becomes: α≤β, the control section 201 reduces the frequency with which the operation is to be carried out.

Referring to FIG. 4, the control section 201 detects the direct current amount β every preset number of the recording sheets conveyed through the image forming apparatus 100, for image formation. As a preset length of time elapses, the control section 201 increases the number preset for recording sheets.

Referring to FIG. 11, once the charge roller 11 becomes stable in the amount of its electrical resistance, it seldom occurs that the detected direct current amount β is smaller than the referential current amount α. Therefore, it is unnecessary to very precisely control the operation for detecting the direct current. Thus, it is desired that the frequency with which the operation is carried out is reduced for the sake of productivity. The frequency Z with which the operation is carried out after the cumulative number (in terms of A4 size sheet) of recording sheets exceeds Y is desired to be in a range of 5,000-10,000. In comparison, the frequency Z' with which the operation is to be carried out while the cumulative number of recording sheets is no more than Y, and therefore, the charge roller 12 may be unstable in the amount of its electrical resistance, is desired to be set higher in order to ensure that the referential current amount α is renewed. The value of Z' is desired to be in a range of 500-2,000. The value of Y is generally in a range of 10,000-100,000.

Referring to FIG. 17 along with FIG. 4, as the main power source is turned on (E1), the control section 201 reads out from the memory, the cumulative number (calculated in terms of A4 size sheet) of recording sheets which have been conveyed through the image forming apparatus 100 since when the drum cartridge in the image forming apparatus 100 is brand-new (E2).

Then, the control section 201 determines whether the cumulative number (in terms of A4 size sheet) is greater than Y (E3). If the cumulative number is greater than Y (Yes in E3), the control section 201 sets the interval with which the operation for estimating the thickness of the photosensitive layer of the photosensitive drum 11, is carried out, to Z (in terms of A4 size sheet) (E4).

Then, the control section 201 determines whether or not the cumulative number (in terms of A4 size) by which recording sheets have been conveyed after the immediately preceding the operation for estimating the photosensitive layer of the photosensitive drum 11 was carried out is no less than Z (E5). As the cumulative number (in terms of A4 size sheet) reaches Z (Yes in E5), the control section 201 carries out the operation, in the first embodiment, for estimating the thickness of the photosensitive layer of the photosensitive drum 11 (B1-B13, in FIG. 1).

If the cumulative number (in terms of A4 size sheet) is no more than Y (No in E3), the control section 201 sets the interval with which the thickness of the photosensitive layer of the photosensitive drum 11 is estimated, is carried out, to Z' (<Z) (in terms of A4 size sheet) (E6). This practice is for the purpose of relatively frequently carrying out the operation for estimating the photosensitive layer of the photosensitive drum 11, if the cumulative number of the recording sheets which have been conveyed through the image forming apparatus 100 since when the drum cartridge in the apparatus 100 is brand-new is relatively small. During a certain length of period which is immediately after the drum cartridge in the image forming apparatus 100 began to be used, the referential current amount α can be more precisely (idealistically) set, and therefore, the thickness of the photosensitive layer of the photosensitive drum 11 can be more precisely estimated, by more frequently carrying out the operation for estimating the photosensitive layer of the photosensitive drum 11.

The control section 201 determines whether or not the cumulative number of recording sheets (calculated in terms of A4 size) which have been conveyed since the immediately preceding operation for estimating the thickness of the photosensitive layer of the photosensitive drum 11 is no less than Z' (E7). If it has reached Z' (Yes in E7), the control section 201 carries out the operation, in the first embodiment, for estimating the thickness of the photosensitive layer of the photosensitive drum 11 (B1-B13 in FIG. 1).

Table 2 given below shows the results of an experiment in which the operation, in the fourth embodiment, for estimating the thickness of the photosensitive layer of the photosensitive drum 11 was carried out while variously setting the threshold value (Y) (calculated in terms of A4 size sheet) for changing the frequency with the operation for estimating the thickness of the photosensitive layer of the photosensitive drum 11 is to be carried out, the frequency Z with which the operation is carried out when the cumulative number of recording sheets conveyed since the drum cartridge is brand-new is no less than Y, and frequency Z1' with which the operation is carried out when the cumulative recording sheet counts is no more than Y.

TABLE 2

| Cumulative number (Y) of the recording sheets (calculated in terms of A4 size sheet) from initial state of the drum cartridge | Cumulative number (Z) of the recording sheets (calculated in terms of A4 size sheet) from previous control | Cumulative number (Z') of the recording sheets (calculated in terms of A4 size sheet) from previous control | Occurrence of error in film thickness detection of the photosensitive drum |
|---|---|---|---|
| 2000 | 500 | 5000 | No |
| 3000 | 2000 | 10000 | No |
| 5000 | 700 | 7000 | No |
| 10000 | 1000 | 8000 | No |

As will be evident from Table 2, the operation, in the fourth embodiment, ensures that the referential current amount α is reliably renewed, preventing therefore the occurrence of the problem that because the direct current amount β is no more than the referential current amount α, the differential current amount γ between the detected direct current amount β and reference current amount α cannot be correctly calculated. Thus, the fourth embodiment makes it possible to accurately estimate the thickness of the photosensitive layer of the photosensitive drum 11.

Embodiment 5

Figure 18:
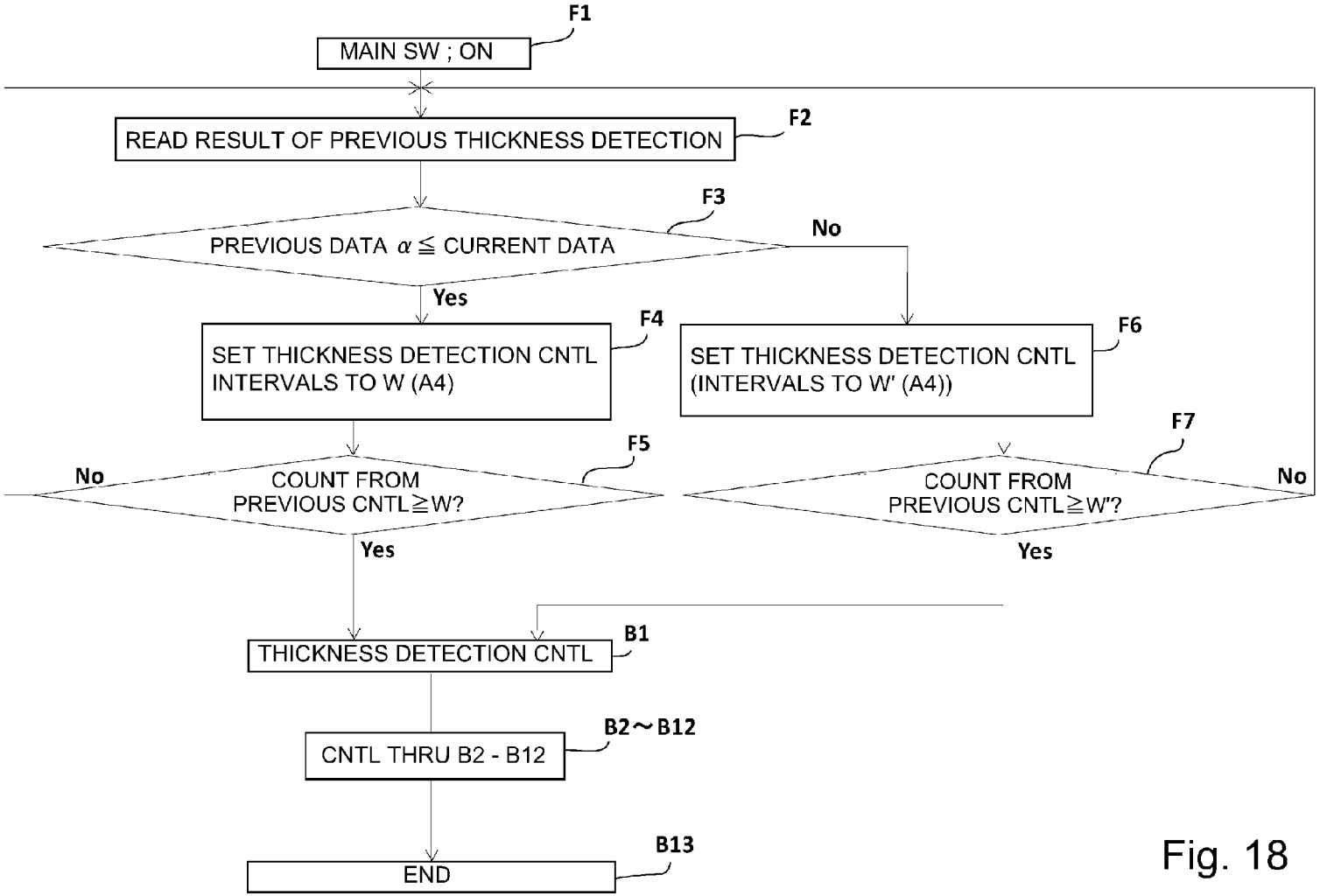
FIG. 18 is a flowchart for the operation, in the fifth embodiment, for estimating the thickness of the photosensitive layer.

FIG. 18 is a flowchart for the operation, in the fifth embodiment, for estimating the thickness of the photosensitive layer of the photosensitive drum 11. In the fourth embodiment, the length of time which is thought to be necessary to stabilize the charge roller 12 in the amount of electrical resistance is simply set to Y (cumulative number of recording sheets calculated in terms of A4 size sheet). In comparison, in the fifth embodiment, based on the direct current amount β detected in the operation for estimating the thickness of the photosensitive layer of the photosensitive drum 11, each charge roller 12 is evaluated differently from the others in terms of the length of time necessary for the charge roller 12 to stabilize in the amount of its electrical resistance. Referring to FIG. 16, once the charge roller 12 stabilizes in the amount of its electrical resistance, it hardly occurs that the detected direct current amount β is no more than the referential current amount α, and therefore, it is unnecessary to frequently carry out the operation for estimating the thickness of the photosensitive layer of the photosensitive drum 11 (detecting direct current amount β). In addition, for the sake of the productivity of the image forming apparatus 100, it is desired that the operation is carried out as infrequently as possible. In this embodiment, therefore, if the relationship between the direct current mount β detected in the operation and the referential current amount α became: α>β (increase), the number by which recording sheets are to be conveyed before the next operation is to be carried is set to W' to increase the frequency with which the referential current amount α is renewed. On the other hand, if the relationship between the direct current amount β detected in the operation and the referential current amount α became: α≤β (decrease), the number by which recording sheets are to be conveyed before the next operation is to be carried is set to W to decrease the frequency with which the referential current amount α is renewed.

If the relationship between the detected direct current amount β and referential current amount α became: α≤β, it is possible that the charge roller 12 has become stable in the amount of its electrical resistance. Therefore, the frequency with which the operation for estimating the thickness of the photosensitive layer of the photosensitive drum 11 is to be carried out is desired to be set in a range of 5,000-10,000 sheets. On the other hand, the value of Z' to which the frequency with which the operation is to be carried out is to be set in order to ensure that the referential current amount α is renewed is desired to be in a range of 500-1,000 sheets.

Referring to FIG. 18 along with FIG. 4, as the main power source of the main assembly of the image forming apparatus 100 is turned on (F1), the control section 201 reads out from the memory, the referential current amount α used in the immediately preceding operation for estimating the thickness of the photosensitive layer of the photosensitive drum 11 (F2).

Then, the control section 201 determines whether or not the relationship between the referential current amount α used in the immediately preceding operation and the direct current amount β detected in the ongoing operation is: α≤β (F3). If it is: α≤β (Yes in F3), the control section 201 sets the frequency with which the operation is to be carried out until the next operation, to W (calculated in terms of A4 size sheet) (F4).

Then, the control section 201 determines whether not the cumulative number (in terms of A4 size) by which recording sheets have been conveyed after the immediately preceding the operation for estimating the photosensitive layer of the photosensitive drum 11 was carried out is no less than W (F5). As the cumulative number (in terms of A4 size sheet) reaches W (Yes in F5), the control section 201 carries out the operation, in the first embodiment, for estimating the thickness of the photosensitive layer of the photosensitive drum 11 (B1-B13, in FIG. 1).

If the relationship between the direct current amount β detected in the ongoing operation and the referential current amount α used in the immediately preceding operation becomes: α>β(No in F3), the control section 201 sets the interval with which the thickness of the photosensitive layer of the photosensitive drum 11 is estimated, is to be carried out, to W' (<W) in terms of A4 size sheet (F6).

Then, the control section 201 determines whether not the cumulative number (in terms of A4 size) by which recording sheets have been conveyed after the immediately preceding the operation for estimating the photosensitive layer of the photosensitive drum 11 was carried out is no less than W1' (F7). As the cumulative number (in terms of A4 size sheet) reaches W' (Yes in F7), the control section 201 carries out the operation, in the first embodiment, for estimating the thickness of the photosensitive layer of the photosensitive drum 11 (B1-B13, in FIG. 1).

Table 3 given below shows the results of an experiment in which the operation, in the fifth embodiment, for estimating the thickness of the photosensitive layer of the photosensitive drum 11 was carried out while variously setting the threshold value (W) (calculated in terms of A4 size sheet) for changing the frequency with the operation for estimating the thickness of the photosensitive layer of the photosensitive drum 11 is to be carried out when α≤β, and the frequency W' with which the operation is carried out when α>β.

TABLE 3

| Cumulative number (W) of the recording sheets (calculated in terms of A4 size sheet) in the case of α ≤ β | Cumulative number (W') of the recording sheets (calculated in terms of A4 size sheet) in the case of α > β | Occurrence of error in film thickness detection of the photosensitive drum |
|---|---|---|
| 500 | 5000 | No |
| 2000 | 10000 | No |
| 700 | 7000 | No |
| 1000 | 8000 | No |

As will be evident from Table 3, carrying out the operation, in the fifth embodiment, ensured that the referential current amount α is reliably renewed, and therefore, prevented therefore the occurrence of the problem that because the direct current amount β is no more than the referential current amount α, the differential current amount γ between the detected direct current amount β and reference current amount α cannot be correctly calculated. Thus, the fifth embodiment made it possible to accurately estimate the thickness of the photosensitive layer of the photosensitive drum 11.

<Reason why DC Amount β Becomes Smaller than Referential Direct Current Amount α>

A charge roller based on ionic conductor is very small in the amount of changes which occur to its electrical resistance with the elapse of time. However, the ion activity in the ionic conductor is substantially affected by the ambient temperature and humidity. Therefore, in terms of the changes in the amount of its electrical resistance attributable to the changes in the ambient temperature and humidity, a charge roller based on ionic conductor is substantially larger than a charge roller based on a material in which carbon particles are dispersed. A charge roller based on carbon has been known that it is slightly affected in the manner in which discharge occurs from a charge roller to a photosensitive drum, by the changes in the amount of its electrical resistance and the changes in its ambience. However, the changes are thought not to have a large effect upon the electrical current which flows between the charge roller and the photosensitive drum. In comparison, a charge roller based on ionic conductor is substantially changed in the amount of its electrical resistance by the external factors such as the changes in the ambient temperature and humidity, increase in its temperature attributable to current flow, etc., even if the changes in the external factors are brief.

The following is thought to be the reason for the above-mentioned changes of a charge roller based on ionic conductor in its electrical resistance: In the case of a charge roller based on ionic conductor, as AC voltage which is high in peak-to-peak voltage is applied to the charge roller, the ionic conductor particles which have been remaining evenly dispersed in the material for the conductive layer of the charge roller, actively move within the material of the conductive layer, in response to the alternating electric field generated by the AC voltage, and move to the spots where they become stable. Therefore, the charge roller becomes nonuniform in microscopic term, in the distribution of the ionic conductor particles, increasing therefore in the distance among the ionic conductor molecule. Consequently the charge roller increases in the amount of its electrical resistance, compared to when the charge roller is in its initial state in which it is uniform in the distribution of the ionic conductor particles.

It is thought that in the case of a charge roller based on ionic conductor, the ionic conductor in the conductive layer of the charge roller continues to actively move in the material for the conductive layer, and therefore, the material for the conductive layer does not stabilize in electrical resistance, until the ionic conductor stabilizes in its arrangement in the material for the electrical conductive layer. As soon as the ionic conductor stabilized in the position in the material for the conductive layer, the conductive layer reduces in the activity of the ionic conductor, and therefore, the material for the conductive layer of the charge roller stabilizes in the amount of electrical resistance. Therefore, the amount of direct current which flows from the charge roller to the photosensitive drum stabilizes at a lower level than when the charge roller is brand-new.

Therefore, in a case where a photosensitive drum is charged by applying oscillatory voltage to a brand-new charge roller, the charge roller continues to reduce in the amount of its electrical resistance until the ionic conductor stabilizes in ion activity. As the charge roller reduces in the amount of its electrical resistance, the amount of the direct current which flows from the charge roller into the photosensitive drum when an oscillatory voltage, that is, a combination of a preset DC voltage, and a preset alternating voltage which is preset in peak-to-peak voltage, is applied to the charge roller, becomes smaller than the referential direct current amount when the charge roller is brand-new.

Generally speaking, as the photosensitive layer of the photosensitive drum 11 reduces in thickness due to abrasion, it increases in electrostatic capacity. Thus, the amount β of the direct current which flows into the photosensitive drum from the charge roller increases.

However, in the case where a roller based on ionic conductor is used as the charge roller 12, the charge roller 12 continues to reduce in the amount of electrical resistance until the ionic conductor particles stabilize in their position in the material for the conductive layer of the charge roller 12. It is thought, therefore, that even if the photosensitive layer of the charge roller 12 does not change in thickness the direction current, the direct current measured in the operation for estimating the thickness of the photosensitive layer of the photosensitive drum 11 reduces in amount.

Further, it has been pointed out that if abnormal electrical discharge occurs between the charge roller 12 and photosensitive drum 11 while the ionic conductor is still very active in the material for the conductive layer of the charge roller 12, direct current flows from the charge roller 12 to the photosensitive drum 11 by a substantially larger amount than after the ionic conductor particles stabilize in their position in the conductor layer of the charge roller 12, until the ions stabilize in their position in the conductive layer.

It also has been pointed out that if the charge roller 12 is brand-new, strong electrical discharge occurs between the charge roller 12 and photosensitive drum 11 when the amount of the direction current which flows from the charge roller 12 to the photosensitive drum 11 is measured, and therefore, a large amount of direct current is detected until the ionic conductor particles in the conductive layer of the charge roller 12 stabilize in position.

The abnormal electrical discharge between the charge roller 12 based on ionic conductor, and photosensitive drum 11, is greater in terms of the effects upon the amount by which direction current flows from the charge roller 12 to photosensitive drum 11, than the changes in the electrical resistance of the charge roller 12 and the changes in the ambience of the image forming apparatus 100. Therefore, it is very important to minimize the effect of this abnormal electrical discharge, from the standpoint of improving the operation for estimating the thickness of the photosensitive layer of the photosensitive drum 11, in terms of the accuracy with which the thickness of the photosensitive layer can be estimated.

Referring to FIG. 11, it is reasonable to think that while $\alpha n > \beta n$, the direct current which flows from the charge roller 12 to the photosensitive drum 11 is not normal, that is, it is unstable, because of the effect of the abnormal electrical discharge. Therefore, the referential current amount $\alpha n-1$, that is, the direct current amount before the relationship between the measured amount $\beta n$ of the direct current and the referential amount $\alpha n$ of the direct current becomes: $\alpha n \leq \beta n$, should not be used as the referential direct current amount. However, that the relationship is: $\alpha n \leq \beta n$, means that the ionic conductor particles have stabilized in their position. Thus, only the direct current amount detected after the ionic conductor in the electrically conductive layer of the charge roller became stable in their position in the conductive layer of the charge roller properly is suitable to replace the referential direct current amount $\alpha n$.

If abnormal electrical discharge occurs between a charge roller and a photosensitive drum during an operation for estimating the thickness of the photosensitive layer of the photosensitive drum, the amount of the direct current which flows between the charge roller and photosensitive drum is likely to be erroneously detected. This abnormal electrical discharge is likely to occur during the period immediately after a brand-new drum cartridge is put to use for the first time. Therefore, during the period immediately after a brand-new drum cartridge is put to use for the first time, the thickness of the photosensitive layer of the photosensitive drum can be more accurately estimated by more frequently renewing the referential direct current amount $\alpha$ than it is in the operation, in accordance with the prior art, for estimating the thickness of the photosensitive layer of a photosensitive drum.

While the invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 018450/2012 filed Jan. 31, 2012, which is hereby incorporated by reference.

What is claimed is:

1. An image forming apparatus comprising:

a photosensitive member;

a charging rotatable member for charging said photosensitive member by applying a voltage comprising a DC voltage component and an AC voltage component;

a current detecting portion for detecting a current flowing when a predetermined inspecting voltage is applied to said charging rotatable member;

a storing portion for storing information corresponding to a reference current;

a supplying portion for supplying a signal for notifying information corresponding to a lifetime of the photosensitive member on the basis of the information stored in said storing portion and an output of the current detecting portion; and a renewing portion for renewing the information stored in said storing portion when an absolute value of the current detected by said current detecting portion is lower than an absolute value of the reference current stored in said storing portion.

2. An apparatus according to claim 1, wherein said current detecting portion detects a DC current, and said supplying portion supplies the signal on the basis of the information stored in said storing portion and the detected DC current.

3. An apparatus according to claim 2, wherein the inspecting voltage is a voltage comprising a DC voltage component and an AC voltage component.

4. An apparatus according to claim 1, wherein said current detecting portion detects, in a period from a main voltage source actuation of the image forming apparatus to start of an initial image formation, the current flowing when the predetermined inspecting voltage is applied to said charging rotatable member, and said supplying portion supplies the signal for notifying the information corresponding to the lifetime of the photosensitive member on the basis of the information stored in said storing portion and the output of said current detecting portion.

5. An apparatus according to claim 1, wherein said photosensitive member and said charging rotatable member are included in a replaceable cartridge, and said storing portion stores, as the information corresponding to the reference current, a value corresponding to a current flowing when the predetermined inspecting voltage is applied, the current being the current first detected by said current detecting portion after the cartridge which is unused is mounted to the image forming apparatus.

6. An apparatus according to claim 1, wherein said charging rotatable member is a charging roller having an elastic layer containing an ion electroconductive material.

7. An apparatus according to claim 1, wherein the notifying is at least one of display of the information corresponding to the lifetime of the photosensitive member on a display portion provided in the image forming apparatus, and display of the information corresponding to the lifetime of the photosensitive member on a terminal outside the image forming apparatus through a communication line.

8. An image forming apparatus comprising:

a photosensitive member;

a charging rotatable member for charging said photosensitive member by applying a voltage comprising a DC voltage component and an AC voltage component;

a current detecting portion for detecting a current flowing when a predetermined inspecting voltage is applied to said charging rotatable member;

a storing portion for storing information corresponding to the current detected by said current detecting portion, wherein said storing portion stores the information relating to the detected current, and an absolute value of the detected current is smaller than a predetermined absolute value; and a supplying portion for supplying a signal for notifying information corresponding to a lifetime of the photosensitive member on the basis of the information stored in said storing portion and an output of said current detecting portion.

* * * * *